US009789660B2

(12) United States Patent
Osada et al.

(10) Patent No.: US 9,789,660 B2
(45) Date of Patent: Oct. 17, 2017

(54) SHEET PROCESSING DEVICE, IMAGE FORMING DEVICE PROVIDED WITH THE SAME, AND FOLDED SHEET PRESSING METHOD

(71) Applicants: Hisashi Osada, Yamanashi-ken (JP); Kazuyuki Kubota, Yamanashi-ken (JP)

(72) Inventors: Hisashi Osada, Yamanashi-ken (JP); Kazuyuki Kubota, Yamanashi-ken (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 256 days.

(21) Appl. No.: 14/750,279

(22) Filed: Jun. 25, 2015

(65) Prior Publication Data

US 2016/0214828 A1 Jul. 28, 2016

(30) Foreign Application Priority Data

Jan. 23, 2015 (JP) ..... 2015-011471
Jan. 23, 2015 (JP) ..... 2015-011472
Jan. 23, 2015 (JP) ..... 2015-011473

(51) Int. Cl.
*B31F 1/00* (2006.01)
*B65H 29/10* (2006.01)
(Continued)

(52) U.S. Cl.
CPC ..... *B31F 1/0035* (2013.01); *B65H 29/10* (2013.01); *B65H 29/28* (2013.01);
(Continued)

(58) Field of Classification Search
CPC ..... B31F 1/0035; B65H 45/04; B65H 2301/51232; B65H 2701/13212
(Continued)

(56) References Cited

U.S. PATENT DOCUMENTS 7,147,598 B2 * 12/2006 Fujimoto ..... B65H 29/12 270/45
7,285,084 B2 * 10/2007 Fujimoto ..... B65H 29/12 270/45
(Continued)

FOREIGN PATENT DOCUMENTS

JP 4217640 B2 2/2009
JP 2014-076903 A 5/2014

*Primary Examiner* — Leslie A Nicholson, III
(74) *Attorney, Agent, or Firm* — Manabu Kanesaka

(57) ABSTRACT

A sheet processing device can prevent a folded sheet bundle from being opened upon accumulation to prevent a reduction in accumulation amount thereof. The sheet processing device includes a pair of pressing rollers pressing a folding loop of a folded sheet bundle in a thickness direction, a support unit mounted to a device frame and supporting a plurality of rows of the pressing roller pairs such that intervals therebetween in the row direction are reduced stepwise, and a gripper member that makes the folding loop of the folded sheet bundle pass through the support unit in a direction that the intervals of the plurality of rows of pressing roller pairs in the row direction are reduced stepwise. The folded sheet bundle passes through the support unit by the gripper member to cause the folding loop to be sequentially pressed by the plurality of rows of pressing roller pairs.

16 Claims, 25 Drawing Sheets

(51) Int. Cl.
*B65H 29/28* (2006.01)
*B65H 31/30* (2006.01)
*B65H 45/18* (2006.01)

(52) U.S. Cl.
CPC ..... *B65H 31/3045* (2013.01); *B65H 45/18* (2013.01); *B65H 2301/34112* (2013.01); *B65H 2301/4474* (2013.01); *B65H 2301/44718* (2013.01); *B65H 2301/51232* (2013.01); *B65H 2701/13212* (2013.01); *B65H 2701/18271* (2013.01); *B65H 2701/18292* (2013.01); *B65H 2801/27* (2013.01)

(58) Field of Classification Search
USPC ..... 270/32, 45, 58.07
See application file for complete search history.

(56) References Cited

U.S. PATENT DOCUMENTS 7,431,274 B2 * 10/2008 Kushida ..... B65H 37/06 270/32
7,673,862 B2 * 3/2010 Kushida ..... B65H 37/06 270/20.1
8,459,630 B2 * 6/2013 Watanabe ..... B65H 45/18 270/32
8,459,631 B2 * 6/2013 Ishikawa ..... B42B 4/00 270/32
8,613,435 B2 * 12/2013 Kato ..... B65H 45/18 270/32
9,221,648 B2 * 12/2015 Sugiyama ..... B31F 1/00

* cited by examiner

SHEET PROCESSING DEVICE, IMAGE FORMING DEVICE PROVIDED WITH THE SAME, AND FOLDED SHEET PRESSING METHOD

BACKGROUND OF THE INVENTION

Field of the Invention

The present invention relates to a device for folding a sheet bundle formed by sheets that are sequentially carried out from an image forming device such as a copier or a printer and accumulated in a bundle and, more particularly, to a sheet processing device that performs pressing against a fold of a two-folded sheet bundle.

Description of the Related Art

There are widely known processing devices that align sheets carried out from an image forming device, bind them, and fold them into a booklet. Among them, some processing devices are configured to saddle-stitch the sheet bundle with a staple or an adhesive and fold the sheet bundle into a booklet.

Such a device performs folding for sheet bundle formed by about 20 to 30 sheets in half; however, there may be a case where the two-folded sheet bundle is unintentionally opened after being discharged from the device, degrading aligning property of the sheet bundle, which results in reduction in accumulation amount.

Thus, it is widely known that, after the folding, the two-folded sheet bundle is subjected to pressing from above and below the fold.

For example, Japanese Patent No. 4,217,640 discloses a device that moves along a fold of a two-folded sheet bundle while pinching/pressing the fold by means of rollers disposed above and below the fold. This device is also provided with a flattening roller that presses the fold from a front side thereof at a position slightly rearward of the pinching/pressing position of the upper and lower rollers. That is, in this device, the rollers that pinch/press the fold from thereabove and therebelow and flattening roller that presses the fold from the front side thereof are formed into one unit, and this unit is moved along the sheet folding direction. Thus, only a portion that is pinched by the rollers can be made flat, thereby reducing wrinkles and breaks of a portion other than the fold due to a difference in gripping force.

Further, as illustrated in detail in FIGS. 11 and 12, Japanese Patent No. 4,217,640 discloses, as a device of a second embodiment of the specification, a device in which a unit provided with a flattening roller that presses the fold from the front side thereof and pinching roller pairs that are arranged at front and rear of the flattening roller so as to pinch/press the fold from thereabove and therebelow moves along the sheet folding direction. A device of such a type moves from outside one end portion of the sheet bundle in its width direction toward inside and passes the other end portion thereof while pinching/press the fold by means of the pinching roller pairs to thereby flatten a back-folded portion.

Further, Jpn. Pat. Appln. Laid-Open Publication No. 2014-76903 discloses a processing device provided with a pair of pressing rollers that press a fold of a two-folded sheet bundle in a sheet width direction and a moving unit that reciprocates the pressing roller pair in the sheet width direction. Further, this processing device is configured to move the pressing roller pair between a position where they are separated away from each other and a position where they are brought into pressure contact with each other. Upon pressing the sheet bundle, the moving unit moves inward from an end portion in the sheet width direction with the pressing roller pair separated away from each other and then moves from the inside to one end portion of the sheet bundle while pressing the sheet bundle. After passing the one end portion, pressing by the pressing roller pair is released to separate the pressing roller pair away from each other. When moving again for pressing, the moving unit passes the one end position of the sheet bundle with the pressing roller pair separated away from each other and then moves from the inside to the other end portion of the sheet bundle while pressing the sheet bundle. In other words, the pressing against the fold of the sheet bundle is started from the inside in the sheet width direction to the one or the other end portion of the sheet bundle.

The above-described devices that perform pressing against the folded sheet bundle carried out from an image forming device or the like have the following problems, respectively.

In the device disclosed in Japanese Patent No. 4,217,640, the roller pair that is previously brought into a pressure contact state is moved along the fold, so that even if the roller pair is reciprocated many times, the roller pair presses the same position, that is, the folded positions are overlapped in a straight line, with the result that the folded sheet bundle may be opened after the pressing. Thus, an accumulating property and an aligning property of the folded sheet bundle cannot be effectively improved.

Also, in the device disclosed in Jpn. Pat. Appln. Laid-Open Publication No. 2014-76903, the pressing against the fold of the sheet bundle by means of the pressing roller pair is repetitively performed with the same pressing force, so that, as in the case of the device disclosed in Japanese Patent No. 4,217,640, the folded positions are overlapped in a straight line, with the result that the folded sheet bundle may be opened after the pressing. Thus, improvement of the accumulating property and aligning property of the folded sheet bundle is conventionally difficult to achieve.

SUMMARY OF THE INVENTION

The present invention has been made in view of the above problems and based on the following idea. That is, when a fold of a folded sheet bundle is subjected to pressing, a plurality of pressing operations are not made for the same position of the fold but for different positions in a thickness direction of the fold, with the result that created fold lines are directed inward in the sheet thickness direction after the last pressing operation.

To solve the above problems, there is provided according to the present invention, a sheet processing device including a device frame, a pair of pressing members that press a folding loop of a folded sheet bundle in a thickness direction thereof, a support unit that is mounted to the device frame and supports a plurality of rows of the pressing member pairs such that intervals therebetween in the row direction are reduced stepwise, and a moving member that makes the folding loop of the folded sheet bundle pass through the support unit in a direction that the intervals of the plurality of rows of pressing member pairs in the row direction are reduced stepwise. The folded sheet bundle is made to pass through the support unit by the moving member so as to cause the folding loop to be sequentially pressed by the plurality of rows of pressing member pairs.

The present invention provides the following effects by having the above features.

The folding loop is made to pass through the plurality of rows of pressing members whose intervals in the row direction are reduced stepwise, and thus the folding loop is pressed at a plurality of different positions, so that the folded position is directed inward, thereby preventing, as much as possible, the folded sheet bundle from being opened upon accumulation, which improves the accumulating property.

BRIEF DESCRIPTION OF THE DRAWINGS

FIGS. 8A to 8C are views each illustrating operation of the gripper member of FIGS. 6 and 7, in which FIG. 8A is a perspective view illustrating a grip release state, FIG. 8B is a view illustrating a mechanism of the gripper member in the grip release state of FIG. 8A, and FIG. 8C is a view illustrating a mechanism of the gripper member in a grip state where the gripper member grips the folded sheet bundle;

FIGS. 20A to 20D are views each illustrating a folded sheet bundle having a plurality of fold lines as a result of pressing operation illustrated in FIGS. 11 to 16 and FIGS. 17 to 19, in which FIG. 20A is a view illustrating a state where the folded sheet bundle is pressed between the first upper and lower pressing rollers, FIG. 20B is a view illustrating a state where the folded sheet bundle is pressed between the second upper and lower pressing rollers, FIG. 20C is a view illustrating a state where the folded sheet bundle is pressed between the third upper and lower pressing rollers of the final step, and FIG. 20D illustrates a folded sheet bundle that has been subjected to the sheet pressing;

FIGS. 21A and 21B are plan views each illustrating a state where the folded sheet bundle having the folding loop is conveyed by the folding roller and the relay roller and then conveyed by the gripper member in a direction crossing the conveying direction of the folding roller and the relay roller, in which FIG. 21A illustrates a case where the folding loop portion is made to pass through the support unit, and FIG. 21B illustrates a case where the conveying direction of the folded sheet bundle is changed to the crossing direction at a position before the support unit such that the folding loop portion is not made to pass through the support unit;

DESCRIPTION OF THE PREFERRED EMBODIMENTS

Hereinafter, the present invention will be described in detail based on illustrated embodiments. The image forming system illustrated in FIG. 1 is constituted by an image forming device A and a sheet processing device B, and a sheet pressing device 50 is incorporated in the sheet processing device B.

[Configuration of Image Forming Device]

Figure 1:
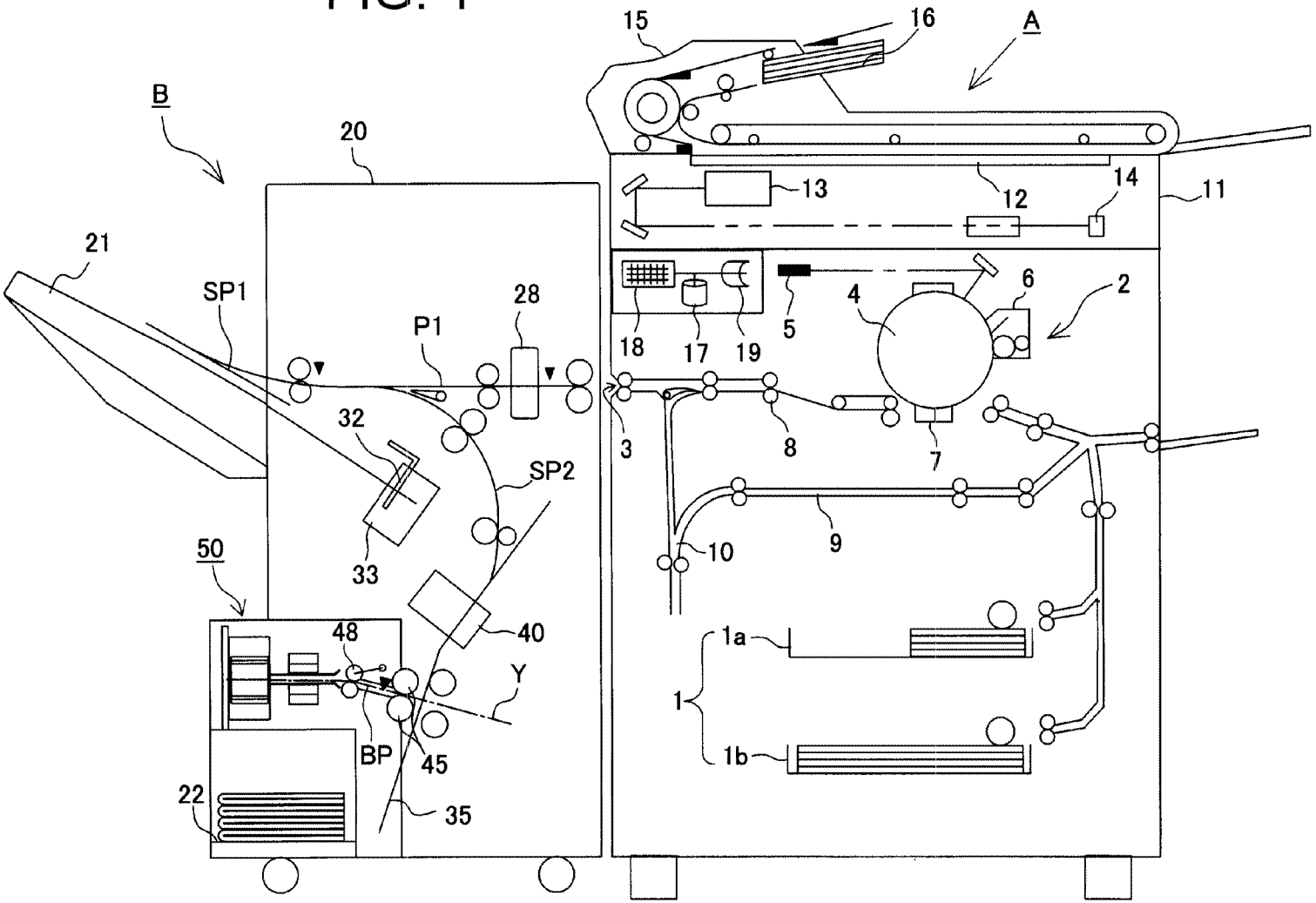
FIG. 1 is an explanatory view of an entire configuration of an image forming system according to the present invention constituted by an image forming device and a sheet processing device incorporating a sheet pressing device.

The image forming device A illustrated in FIG. 1 feeds a sheet from a sheet supply section 1 to an image forming section 2, performing printing for the sheet in the image forming section 2, and carries out the resultant sheet from a main body sheet discharge port 3. In the sheet supply section 1, sheets of a plurality of sizes are housed in sheet cassettes 1*a* and 1*b*, respectively, and sheets of a specified size are fed to the image forming section 2 while being separated one from another. The image forming section 2 includes, for example, an electrostatic drum 4, a print head (laser emitter) 5, a developing unit 6, a transfer charger 7, and a fixing unit 8. The print head 5, developing unit 6, transfer charger 7, and fixing unit 8 are disposed around the electrostatic drum 4. In this image forming section 2, the laser emitter 5 forms an electrostatic latent image on the electrostatic drum 4, the developing unit 6 makes toner adhere to the obtained electrostatic latent image, the transfer charger 7 transfers an image onto the sheet, and the fixing unit 8 thermally fixes the image to the sheet. The sheets with the thus formed image are sequentially carried out from the main body sheet discharge port 3. A reference numeral 9 is a circulation path for double-sided printing. More specifically, the sheet on a front side of which the image has been printed is fed from the fixing unit 8, reversed in a main body switchback path 10, and enters the circulation path 9, along which the sheet is fed once again to the image forming section 2 for printing on a back side of the sheet. The thus double-side printed sheet is reversed in the main body switchback path 10 and carried out from the main body sheet discharge port 3.

A reference numeral 11 is an image reading device. The image reading device 11 scans a document sheet set on a platen 12 using a scan unit 13, and light reflected from the document and passing through a reflective mirror and a condenser lens is electrically read by a photoelectric conversion element 14. This image data is subjected to, e.g., digital processing in an image processing section, transferred to a data storage section 17, from which an image signal corresponding to the resultant image data is transmitted to the laser emitter 5. A reference numeral 15 is a document feeder that feeds a document sheet housed in a document stacker 16 to the platen 12.

A controller is provided in the image forming device A having the above configuration, and image formation conditions, for example, print-out conditions such as sheet size designation, color/monochrome printing designation, number-of-copies designation, one-side/two-side printing designation, and scaling printing designation are set through a control panel 18. Further, in the image forming device A, image data read by the scan unit 13 or image data transferred from an external network is stored in the data storage section 17. The image data is transferred from the data storage section 17 to a buffer memory 19, from which data signals corresponding to the image data are sequentially transmitted to the laser emitter 5.

Upon input of the image formation conditions, sheet processing conditions are also input (designated) through the control panel 18. Through input of the sheet processing conditions, the following modes are designated. The image forming device A forms an image on the sheet according to the image formation conditions and post processing conditions.

[Configuration of Sheet Processing Device]

The sheet processing device B connected to the above-described image forming device A is configured to receive the image-formed sheet from the main body sheet discharge port 3 of the image forming device A and perform sheet processing according to one of the following modes.

The modes include: (1) "print-out mode" in which the image-formed sheet is housed in a first sheet discharge tray 21; (2) "staple-binding mode" in which the sheets from the main body sheet discharge port 3 are aligned in a bundle, bound by an end face stapler 33, and housed in the first sheet discharge tray 21; (3) "saddle stitching and folding mode" in which the sheets from the main body sheet discharge port 3 are aligned in a bundle in a stacker section 35 which is a second processing tray, bound at a portion near a center thereof using a saddle stitching stapler 40, folded into a booklet, and stored in a second sheet discharge tray 22; and (4) "folded sheet pressing mode" in which a sheet loop is pressed at a fold of a sheet bundle that has been saddle-stitched and folded into a booklet and then stored in the second sheet discharge tray 22.

Figure 2:
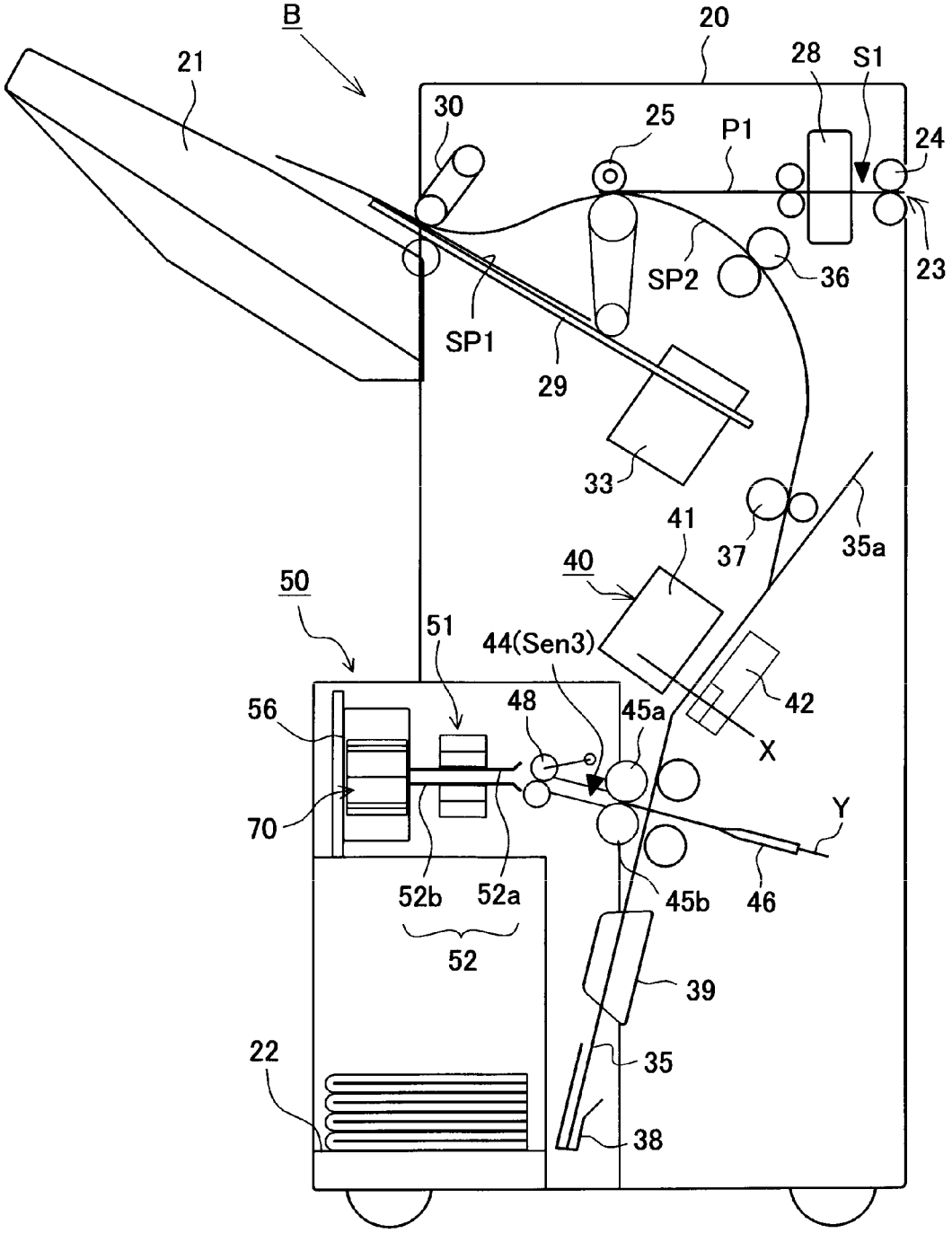
FIG. 2 is an explanatory view of an entire configuration of the sheet processing device according to the present invention that incorporates the sheet pressing device.

As illustrated in FIG. 2, the sheet processing device B includes, in a casing 20 thereof, the first and second sheet discharge trays 21 and 22 and a sheet carry-in path P1 having a carry-in port 23 connected to the main body sheet discharge port 3. The sheet carry-in port P1 is constituted by a straight line path extending in a substantially horizontal direction. Further, first and second switchback conveying paths SP1 and SP2 are branched from the sheet carry-in path P1, along which the sheet is conveyed in a reverse direction to the conveying direction of the sheet conveyed on the sheet carry-in path P1. The first switchback conveying path SP1 is branched from the sheet carry-in path P1 at a path downstream side, and the second switchback path SP2 is branched from the sheet carry-in path P1 at a path upstream side. The first and second switchback conveying paths SP1 and SP2 are distanced from each other.

In such a path configuration, in the sheet carry-in path P1, there are disposed a carry-in roller 24 and a sheet discharge roller 25. The sheet discharge roller 25 is configured to be rotatable in normal and reverse directions. Further, in the sheet carry-in path P1, there is disposed a path switching piece (not illustrated) for guiding the sheet to the second switchback conveying path SP2, and the piece is coupled to an operation means such as a solenoid. Further, the sheet carry-in path P1 has, on the downstream side of the carry-in roller 24, a stamp means for performing stamping on the sheet fed from the carry-in port 23 or a single-sheet punching unit 28 for punching the sheets fed from the carry-in port 23 one by one.

[Configuration of First Switchback Conveying Path SP1]

The first switchback conveying path SP1 disposed on the downstream side (rear end portion of the device) of the sheet carry-in path P1 as illustrated in FIG. 2 is configured as described below. The sheet carry-in path P1 is provided, at its exit end, with the sheet discharge roller 25 and a processing tray 29 on which the sheets fed by the sheet discharge roller 25 are stacked and supported. There is disposed, above the processing tray 29, a normal/reverse rotation roller 30 capable of moving up and down between a position to come into contact with the sheet on the tray and a standby position spaced apart therefrom. The normal/reverse rotation roller 30 is controlled to rotate in a clockwise direction in FIG. 2 when the sheet approaches the processing tray 29 to which the normal/reverse rotation roller 30 is coupled, and to rotate in a counterclockwise direction after a sheet rear end passing through the sheet discharge roller 25 enters the processing tray 29. Thus, the first switchback conveying path SP1 is positioned above the processing tray 29.

Further, the first sheet discharge tray 21 is located downstream of the first switchback conveying path SP1 and is configured to support a leading end of the sheet to be guided to the first switchback conveying path SP1 and the second switchback conveying path SP2.

An end face stapler 33 is disposed at a rear end portion of the processing tray 29 in the sheet discharge direction. The illustrated end face stapler 33 staples a sheet bundle on the processing tray 29 at one or more positions of a rear end edge of the sheet bundle. The staple-bound sheet bundle is discharged onto the first sheet discharge tray 21.

The first switchback conveying path SP1 configured as described above aligns the sheets fed by the sheet discharge roller 25 on the processing tray 29 in the "(2) staple-binding mode" as described above, and the end face stapler 33 staples the sheet bundle at one or more portions of the rear end edge of this sheet bundle. In the "(1) print-out mode", the sheet fed by the sheet discharge roller 25 is not subjected to the switchback, but conveyed along the processing tray 29 and discharged to the first sheet discharge tray 21 by a rotation of the normal/reverse rotation roller 30 in a clockwise direction in FIG. 2.

[Configuration of Second Switchback Conveying Path SP2]

The following describes a configuration of the second switchback conveying path SP2 branched from the sheet carry-in path P1. The second switchback conveying path SP2 is a conveying path for guiding a switchback-conveyed sheet. That is, in a state where the sheet is nipped by the sheet discharge roller 25, rotation of the sheet discharge roller 25 is changed from the normal rotation to the reverse rotation, with the result that the sheet is switchback-conveyed along the switchback conveying path SP2. As illustrated in FIG. 2, the second switchback conveying path SP2 is located in a substantially vertical direction inside the casing 20. A conveying roller 36 is located at an inlet of the second switchback conveying path SP2, and an exit conveying roller 37 is located at an outlet of the second switchback conveying path SP2. A stacker section 35 constituting a second processing tray that aligns and temporarily stacks the sheets fed along the second switchback conveying path SP2 is provided downstream of the second switchback conveying path SP2. The illustrated stacker section 35 includes a conveying guide that transfers the sheet. A saddle stitching stapler 40 and a folding roller 45 are arranged along the stacker section 35. The configuration of these components will be sequentially described below.

[Configuration of Stacker Section]

The stacker section 35 is formed of a guide member that guides the sheet being conveyed. The stacker section 35 is configured such that the sheets are stacked and housed thereon. The illustrated stacker section 35 is connected to the second switchback conveying path SP2 and located in a center portion of the casing 20 so as to extend in the substantially vertical direction. This allows the device to be compactly configured. The stacker section 35 is shaped to have an appropriate size to house maximum sized sheets. In particular, the illustrated stacker section 35 is curved or bent so as to project toward an area in which the saddle stitching stapler 40 and the folding roller 45 to be described later are arranged.

A switchback approaching path 35*a* is connected to a conveying direction rear end of the stacker section 35. The switchback approaching path 35*a* overlaps the outlet end of the second switchback conveying path SP2. This is to allow the leading end of a carried-in (succeeding) sheet fed from the exit conveying roller 37 on the second switchback conveying path SP2 to overlap the rear end of the stacked (preceding) sheets supported on the stacker section 35 to ensure the page order of the stacked sheets. A leading end regulating member (hereinafter, referred to as stopper 38) regulating a sheet leading end of the sheet in the conveying direction is located downstream of the stacker section 35. The stopper 38 is supported by a guide rail and the like so as to be movable along the stacker section 35. The stopper 38 is configured to be movable to a position where the sheet is carried in the stacker section 35 by means of a not illustrated shift means, a position where the sheet bundle is bound at a center thereof in the stacking direction, and a position where the sheet bundle is folded by the folding roller 45. Further, an aligning means 39 for aligning the sheets is provided in the middle of the stacker section 35 in the sheet conveying direction. The aligning means 39 presses a side edge of the sheet for alignment every time the sheet is carried in.

[Saddle Stitching Stapler]

The saddle stitching stapler 40 positioned above the stacker section 35 includes a driver unit 41 and a clincher unit 42 which are arranged opposite to each other with respect to the stacker section 35. The driver unit 41 drives a staple into a sheet bundle. The clincher unit 42 bends leg portions of the driven staple in a direction facing each other. With this configuration, the sheet bundle is bound at a binding position X illustrated in FIG. 2 corresponding to the half of a sheet length. The saddle stitching stapler 40 may perform the binding not only by using a metallic staple, but also by using a paper-made staple, by performing press-bonding (without use of the metallic or paper-made staple), or by forming a cut in the paper sheets (without use of the metallic or paper-made staple).

[Folding Roller]

The following describes a configuration of the folding roller 45. As illustrated in FIG. 2, the folding roller 45 for folding the sheet bundle and a folding blade 46 for inserting the sheet bundle into a nip position of the folding roller 45 are disposed at a folding position Y set on the downstream side of the above-described saddle stitching stapler 40. As illustrated in FIGS. 3A to 3D, the folding roller 45 is constituted by an upper pressure contact roller 45*a* and a lower pressure contact roller 45*b* which are brought into pressure contact with each other. The upper and lower pressure contact rollers 45*a* and 45*b* each have a length slightly longer than the maximum width of the sheet. The folding roller pair 45 are biased in the pressure contact direction by a not illustrated compression spring. The folding roller pair 45 are each formed of a material, such as rubber, having a comparatively large friction coefficient.

Further, the folding blade 46 configured to be moved toward the pressure contact position of the folding roller pair 45 is disposed so as to be capable of advancing and retreating. After the sheet bundle is saddle-stitched by the saddle stitching stapler 40, the folding blade 46 is moved to push the binding position between the folding roller pair 45 to cause the folding roller pair 45 to be rotated while pressed against each other, whereby the saddle-stitched sheet bundle is center-folded. In the middle of the above folding processing, the folding blade 46 is returned to its original position and waits for the next sheet bundle. A movement path along which the folding blade 46 is moved is illustrated as the folding position Y which coincides with the binding position X of the sheet bundle.

Figure 3A:
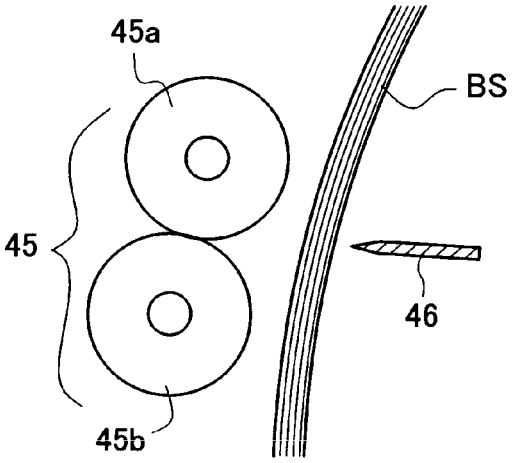
FIGS. 3A to 3D are explanatory views of folding processing performed by a folding roller in the sheet processing device.
Figure 3B:
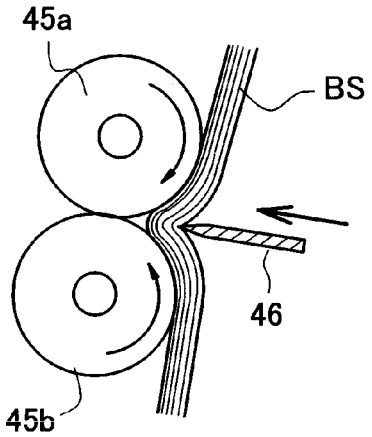

Hereinafter, a procedure of folding processing of the stacked sheet bundle or stacked and saddle-stitched sheet bundle will be described using FIGS. 3A to 3D. The sheets are stopped by the stopper 38 and stacked as a sheet bundle. Then, the stopper 38 is moved upward to allow the saddle stitching stapler 40 to saddle-stitch the sheet bundle at about a center position of the sheet bundle in the sheet conveying direction. After the saddle stitching, the stopper 38 supporting the resultant sheet bundle is moved down and stopped at a position where the sheet binding position coincides with a folding position. This state is illustrated in FIG. 3A. This position coincides with the pressure contact position between the upper and lower pressure contact rollers 45*a* and 45*b* constituting the folding roller 45. Thereafter, the upper and lower pressure contact rollers 45*a* and 45*b* are rotated in the same direction by a not illustrated drive motor, and the folding blade 46 is moved so as to be pushed to the pressure contact position. This state is illustrated in FIG. 3B.

Figure 3C:
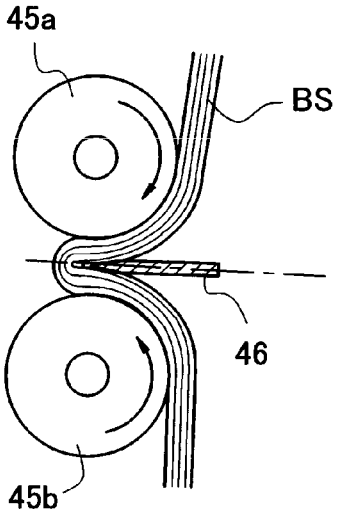
Figure 3D:
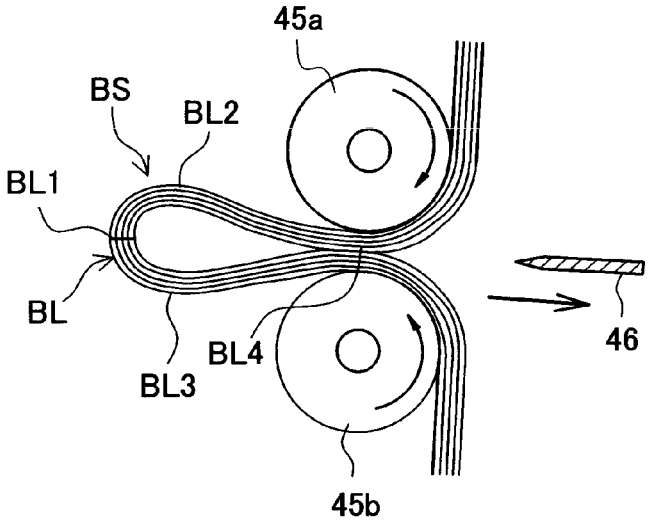

Then, as illustrated in FIG. 3C, the upper and lower pressure contact rollers 45*a* and 45*b* continue being rotated in the same direction, while the folding blade 46 is once stopped before the pressure contact position. Then, the folding blade 46 is retracted in a returning direction. Afterward, when the upper and lower pressure contact rollers 45*a* and 45*b* are further rotated in the same direction, a folded sheet bundle BS to be folded is folded while forming a certain loop BL as illustrated in FIG. 3D. In this state, there are formed a folding loop leading end BL1 which is a fold formed as a result of pushing of the folding blade 46, an upper loop BL2 swelling upward with the folding loop leading end BL1 as a center, a lower loop BL3 swelling downward, and a loop base end portion BL4 that presses the sheets so as to maintain the loop, and the folding operation is once stopped.

The loop at the fold is generated due to action of force for the sheet bundle to be opened outward. Thus, the larger the number of the sheet bundle BS to be folded, the greater the force for the sheet bundle itself to be opened and spread. Accordingly, if no countermeasure is taken, a discharged sheet bundle is opened. So, in the present invention, sheet pressing to be described below is performed.

The folding roller 45 may be used for detecting a thickness of the sheet bundle BS to be folded. That is, by measuring a difference between a distance between axes of the upper and lower pressure contact rollers 45*a* and 45*b* in a state where the sheet bundle BS is not inserted and a distance therebetween in a state where the sheet bundle BS is inserted, the thickness of the sheet bundle BS can be detected.

[Sheet Pressing Device]

Hereinafter, the sheet pressing device 50 constituting a part of the sheet processing device according to the present invention will be described. The sheet pressing device 50 is a device for preventing the folded sheet bundle BS from being opened.

As illustrated in FIG. 2, the sheet pressing device 50 is disposed downstream of the above-described folding roller 45. There is provided, at an entrance portion of the sheet pressing device 50, a sheet bundle detection sensor (SEN3) 44 that detects the folded sheet bundle BS which is conveyed by the folding roller 45 with the folding loop side as the head. A relay roller 48 (relay roller pair) serving as a first conveying member (bundle conveying roller) that conveys downstream the folded sheet bundle is provided downstream of the sheet bundle detection sensor 44. The pair of relay rollers 48 can contact and separate from each other. A guide plate 52 that guides conveyance of the folded sheet bundle BS is provided downstream of the relay roller 48. The guide plate 52 includes an upper guide plate 52*a* and a lower guide plate 52*b*. In the sheet pressing device 50, a folded sheet bundle conveying path BP is formed by the guide plate 52.

Further, a gripper member 51 is provided at a side of the guide plate 52. The gripper member 51 serves as a second conveying member that can grip the folded sheet bundle from both sides in a thickness direction thereof. The gripper member 51 conveys the folded sheet bundle BS to the near side in the drawing, i.e., in a direction crossing the conveying direction of the folded sheet bundle BS by the relay roller 48. Further, a support unit 56 is provided at a side of a position which is an end point of conveyance of the folded sheet bundle BS by the relay roller 48. The support unit 56 has pressing rollers 70 that press stepwise the folded sheet bundle pulled and conveyed by the gripper member 51. A second sheet discharge tray 22 that accumulates the processed folded sheet bundle BS is provided downstream of the support unit 56.

Hereinafter, the relay roller 48, the gripper member 51, and the support unit 56 supporting the pressing rollers 70 will be described in terms of their configurations and mechanisms.

[Relay Roller (First Conveying Member/Bundle Conveying Roller)]

Figure 4:
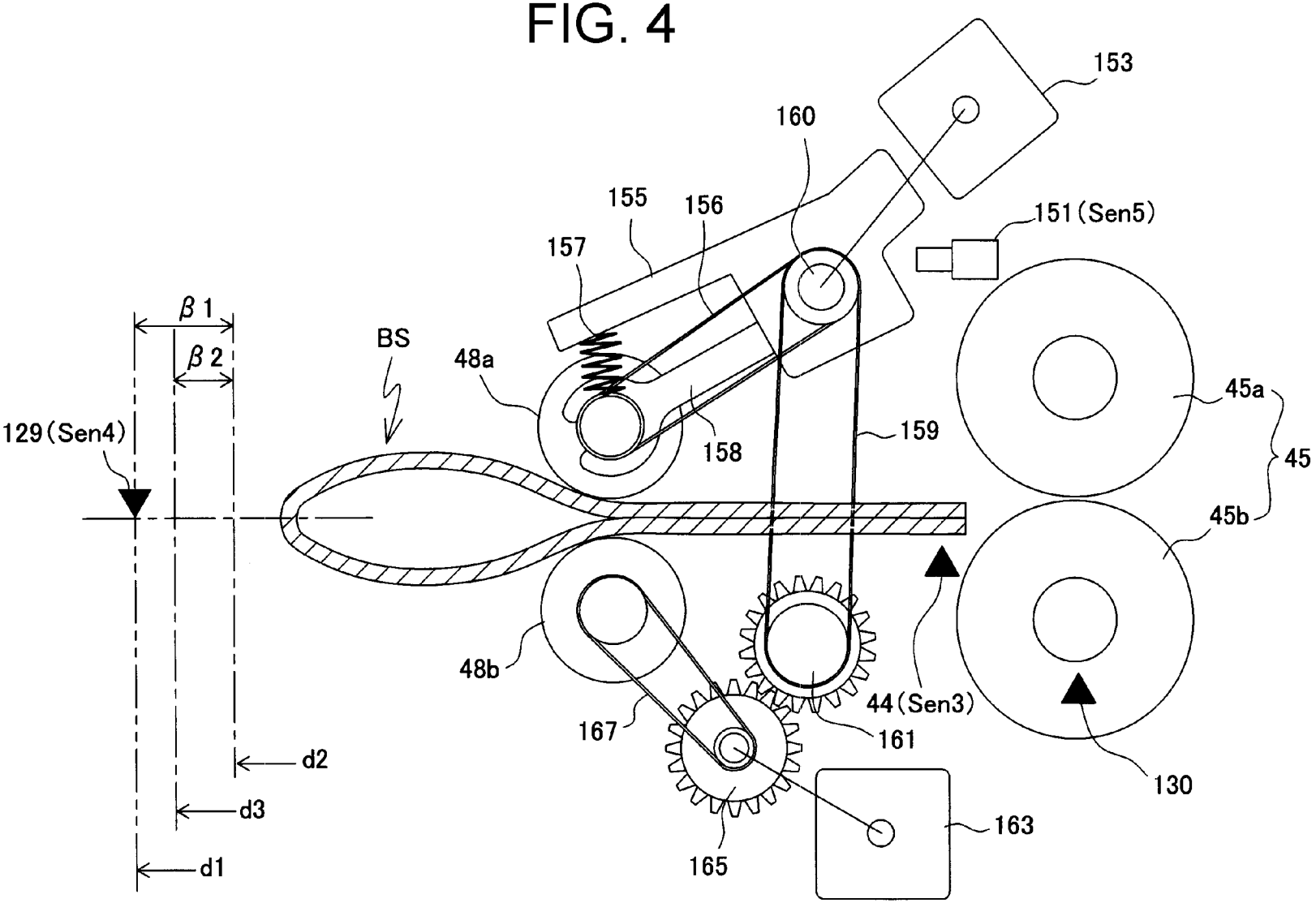
FIG. 4 is a view illustrating a mechanism of a relay roller that conveys a folded sheet bundle conveyed from a folding roller of FIG. 3.

With reference to FIG. 4, the relay roller 48 that conveys downstream the folded sheet bundle BS having the folding loop that is conveyed from the folding roller 45 will be described. The relay roller 48 includes a relay upper roller 48*a* disposed above the folded sheet bundle BS in a thickness direction thereof and a relay lower roller 48*b* disposed at a lower surface side of the folded sheet bundle BS. In the present embodiment, three relay upper rollers 48*a* and three relay lower rollers 48*b* are arranged in a sheet width direction (see FIG. 21). The relay roller 48 is driven into rotation by a bundle feed motor 163. The relay upper roller 48*a* is driven through timing belts 156 and 159, and the relay lower roller 48*b* is driven through timing belts 167. The relay upper roller 48*a* and the relay lower roller 48*b* are configured to be rotated at the same speed.

Further, the relay upper roller 48*a* can contact and separate from the relay lower roller 48*b*. More specifically, the relay upper roller 48*a* can be moved between a pressure contact position where it nips and conveys the folded sheet bundle BS with the relay lower roller 48*b* and a pressure contact release position where it separates from the folded sheet bundle BS to allow the folded sheet bundle BS to be conveyed by the gripper member 51. In this manner, the pair of relay rollers can contact and separate from each other.

The relay upper roller 48*a* is connected to a support lever 158 rotatably supported by a drive shaft 160. A swing lever 155 integrally formed with the drive shaft 160 is mounted to the drive shaft 160, and a pressing spring 157 is disposed between a leading end side of the swing lever 155 and the support lever 158. The drive shaft 160 can be rotated by a swing motor 153. Thus, when the swing motor 153 is driven to rotate the drive shaft 160 in a counterclockwise direction in the drawing, the relay upper roller 48*a* is moved to a direction pushing the folded sheet bundle BS against the relay lower roller 48*b*. When the swing motor 153 is driven further, the swing lever 155 compresses the pressing spring 157, causing the relay upper roller 48*a* to bias the folded sheet bundle BS with a larger biasing force.

When it is necessary to separate the relay upper roller 48*a* from the relay lower roller 48*b*, the swing motor 153 is driven to rotate the drive shaft 160 in a clockwise direction in the drawing. Then, the swing lever 155 is also rotated in the clockwise direction to move the support lever 158 locked by the pressing spring 157 in the same direction, thereby causing the relay upper roller 48*a* to be moved upward to a separate position separated from the folded sheet bundle BS. When the relay upper roller 48*a* is situated at this position, constraint to the folded sheet bundle BS is released, thereby allowing the folded sheet bundle BS to be moved in the crossing direction by the gripper member 51 as the second conveying member to be described later. A position of the swing lever 155 is detected by a swing position sensor (SEN5) 151 for positioning.

The relay roller 48 feeds the folded sheet bundle BS up to a d1 position where a leading end of the loop of the folded sheet bundle BS is detected by a sheet bundle leading end detection sensor (SEN4) 129, which is distanced from a position where the folded sheet bundle BS is detected by the sheet bundle detection sensor (SEN3) 44 by d1, a d2 position upstream of the d1 position by β1, and a d3 position downstream of the d2 position by β2. The above feed amount is set by a feed amount of the bundle feed motor 163. By changing the hand-over position depending on the number of sheets forming the folded sheet bundle, a case where the sheet pressing is executed for the folding loop or not is selected. This point will be described in detail later with reference to FIGS. 21A and 21B and subsequent drawings.

[Arrangement and Mechanism of Gripper Member]

With reference to FIGS. 5 to 8A to 8C, an arrangement and a mechanism of the gripper member 51 will be described. The gripper member 51 is a second conveying member that grips the folded sheet bundle BS processed by the folding roller 45 and then conveyed by the relay roller 48 from both sides in the thickness direction thereof so as to leave the folding loop and conveys the folded sheet bundle BS in a direction crossing the conveying direction of the relay roller 48.

Figure 5:
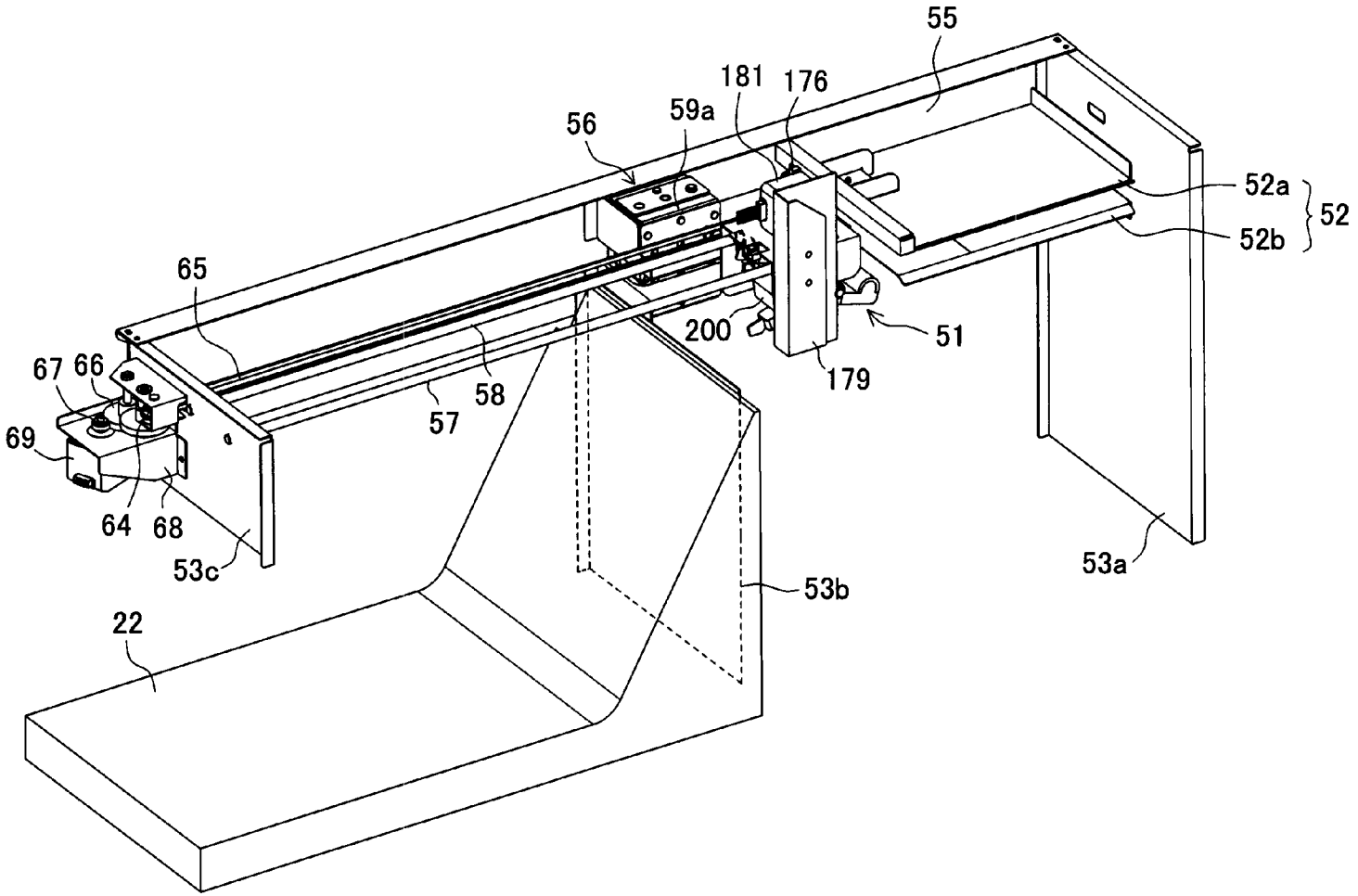
FIG. 5 is a perspective view illustrating a support unit that supports a pressing roller and a moving mechanism of a gripper member that pulls the folded sheet bundle having a loop.

FIG. 5 is a perspective view illustrating the support unit 56 supporting the pressing rollers 70 and a moving mechanism of the gripper member 51 that pulls the folded sheet bundle BS having the loop in the direction crossing the conveying direction of the relay roller 48.

A device frame 55 is fitted with a rear frame 53*a*, a front frame 53*c*, and a middle frame 53*b*. The rear frame 53*a* is provided at a rear side of the sheet pressing device 50, the front frame 53*c* is provided at a front side, and the middle frame 53*b* is provided between the rear frame 53*a* and the front frame 53*c*. A guide plate 52 that guides the folded sheet bundle BS is provided near the rear frame 53*a*. The guide plate 52 includes an upper guide plate 52*a* and a lower guide plate 52*b*.

The gripper member 51 grips a slightly rear portion of the folding loop of the folded sheet bundle BS so as to leave the folding loop, so as to move, in the direction (to the left, in FIG. 5) crossing the conveying direction of the relay roller 48, the folded sheet bundle BS conveyed from the relay roller 48. The gripper member 51 is fitted with a gripper opening/closing cam 200 for switching between a grip state where the gripper member 51 grips the folded sheet bundle BS and a grip release state where the gripper member 51 releases its grip state and a gear frame 179 supporting a gripper opening/closing motor 181 that drives the gripper opening/closing cam 200.

The gripper member 51 is slidably supported by a front guide rail 57 and a rear guide rail 58 which are positioned above the second sheet discharge tray 22. Pulling and returning operations of the gripper member 51 are made by movement of a moving belt 65 stretched between right and left pulleys 63 and 64 fixedly mounted to the sheet pressing device 50. Although details will be described later, on the left pulley 64 side, a gripper member moving motor 69, a motor output gear 67 coupled to an output shaft of the motor 69, and a transmission gear 66 are mounted to a motor gear unit 68 and drive the left pulley 64 into rotation. That is, the above components on the left pulley 64 side constitute a moving member for moving the folded sheet bundle BS.

There is fixedly provided to the device frame 55 the support unit 56 supporting the pressing rollers 70 that press the leading end loop portion of the folded sheet bundle BS from above and below in a loop thickness direction while the gripper member 51 grips the folded sheet bundle BS and pulls it to a portion above the second sheet discharge tray 22.

Figure 6:
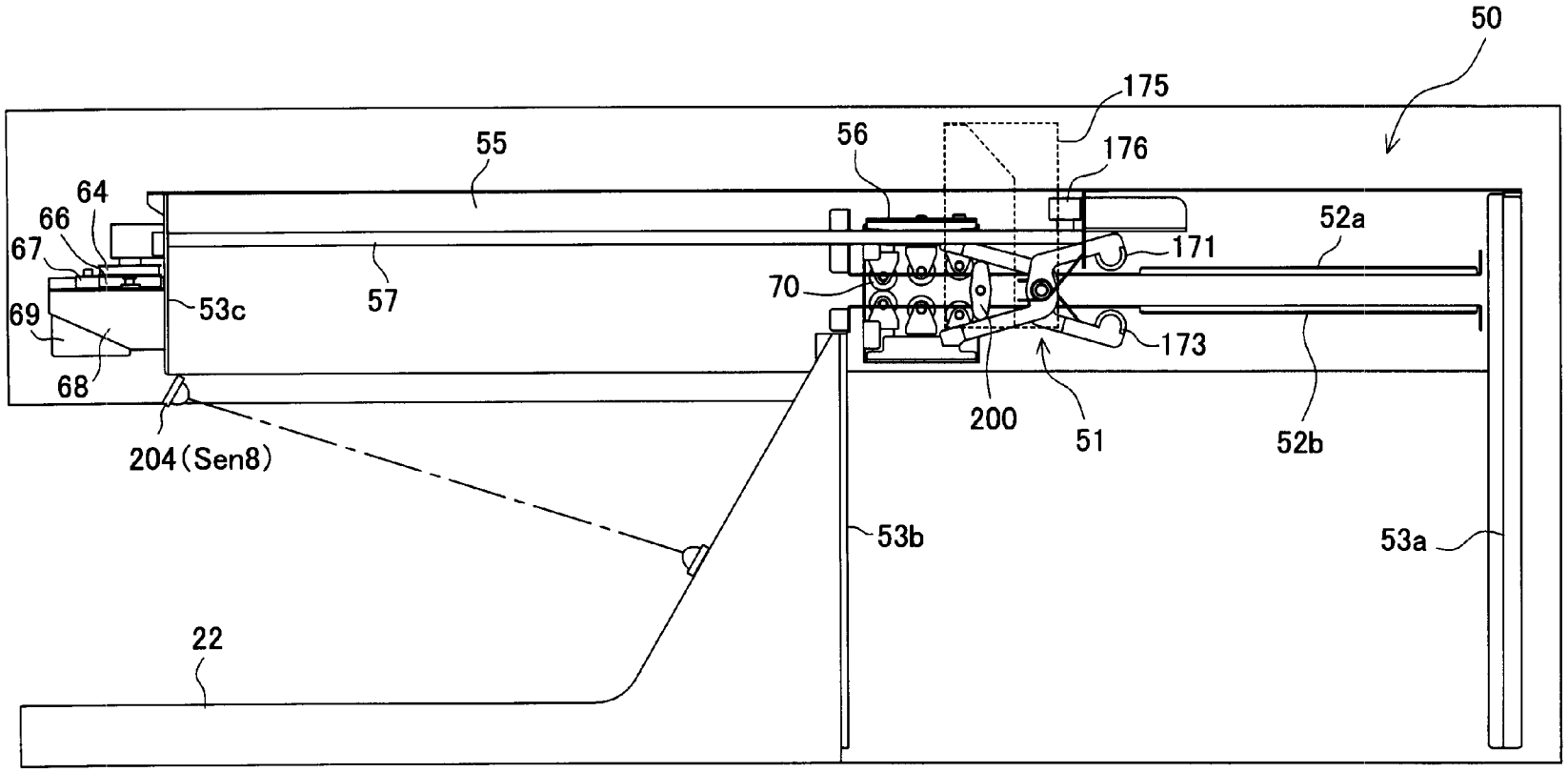
FIG. 6 is a cross-sectional view illustrating a positional relationship between the gripper of the sheet pressing device of FIG. 2 situated at a grip position and a second sheet discharge tray.

FIG. 6 is a view illustrating a cross section of the gripper situated at a grip position of FIG. 5. The grip position is a position where a gripper frame 175 of the gripper member 51 is detected by a gripper unit home position sensor (SEN6) 176 mounted to the device frame 55. The gripper member 51 includes an upper gripper 171 that presses the folded sheet bundle BS from above and a lower gripper 173 that presses the folded sheet bundle BS from below and is configured to be opened/closed by the opening/closing cam 200. In the grip release state at the position of FIG. 6, the gripper member 51 waits for carry-in of the folded sheet bundle BS having the folding loop conveyed by the relay roller 48.

Figure 7:
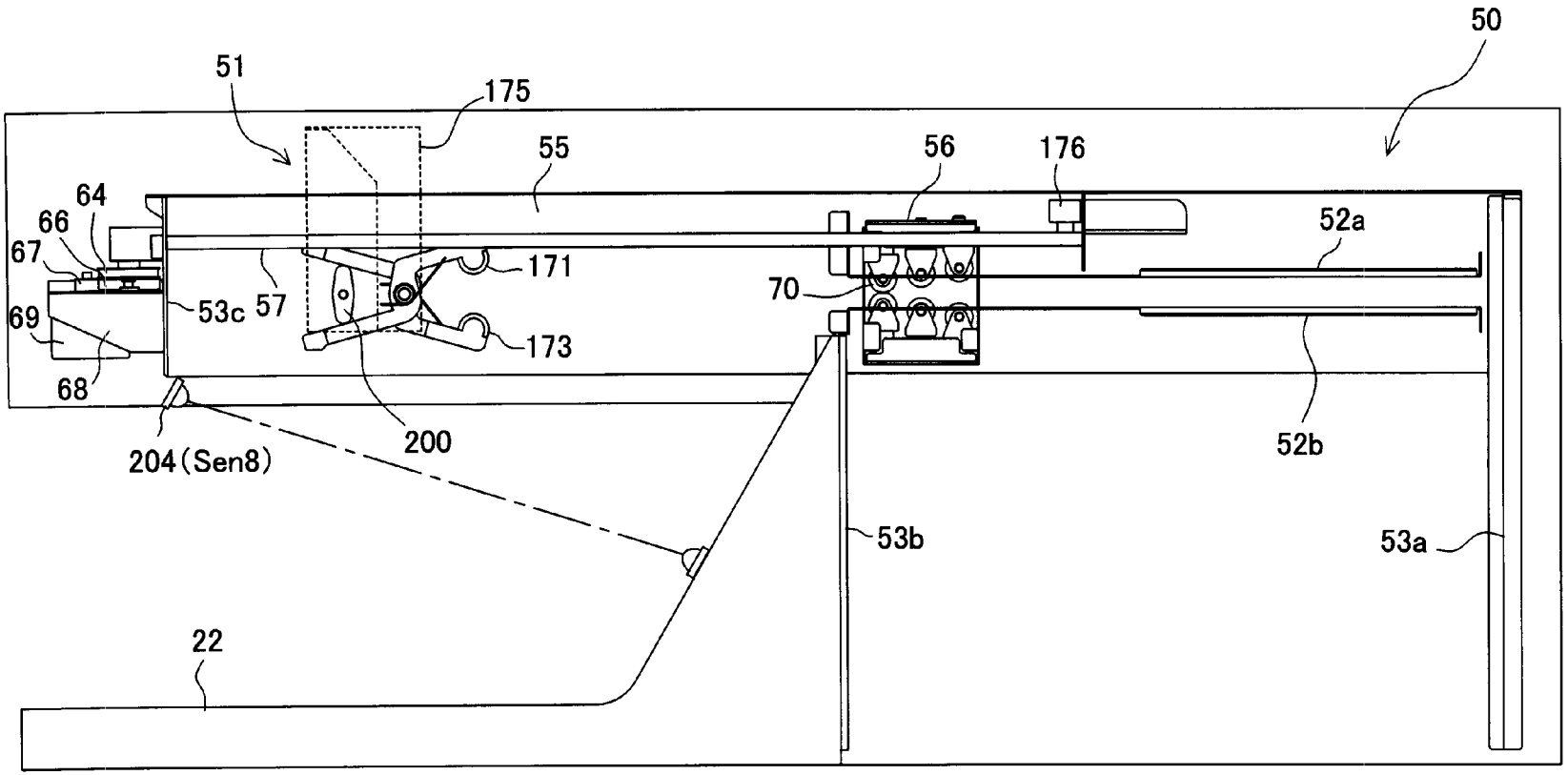
FIG. 7 is a view illustrating a state where the gripper member is moved in a direction crossing the conveying direction of the folding roller to a discharge position where it discharges the folded sheet bundle to the second sheet discharge tray.

FIG. 7 is a view illustrating a state where the gripper member 51 is situated at a discharge position where it releases the grip state to discharge the folded sheet bundle BS to the second sheet discharge tray 22. When the gripper member 51 gripping the folded sheet bundle BS is moved to the position illustrated in FIG. 7, the grip state between the upper gripper 171 and the lower gripper 173 is released to discharge the folded sheet bundle BS to the second sheet discharge tray 22. The second sheet discharge tray 22 is provided with a bundle discharge sensor (SEN8) 204, by which it is checked whether or not the folded sheet bundle BS has been dropped to the second sheet discharge tray 22 and whether or not the second sheet discharge tray 22 is full.

Figure 8A:
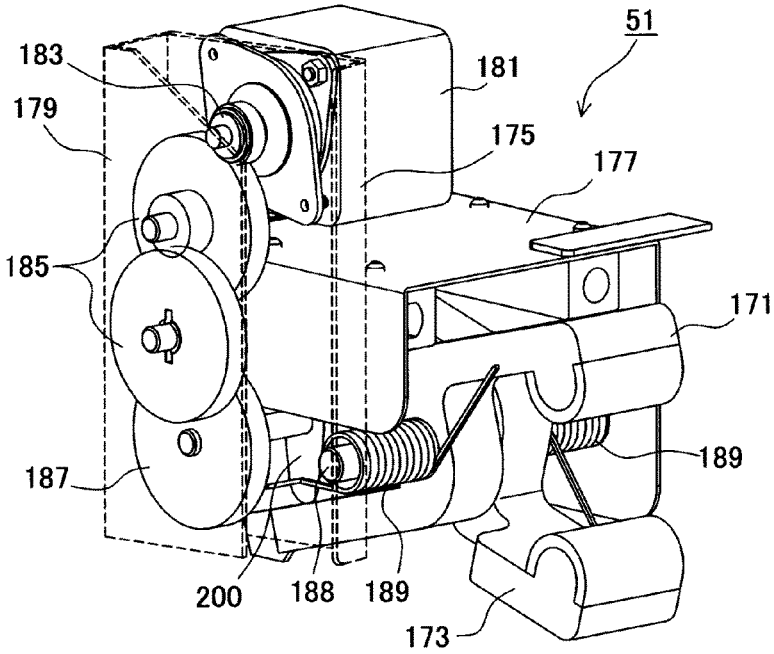
Figure 8B:
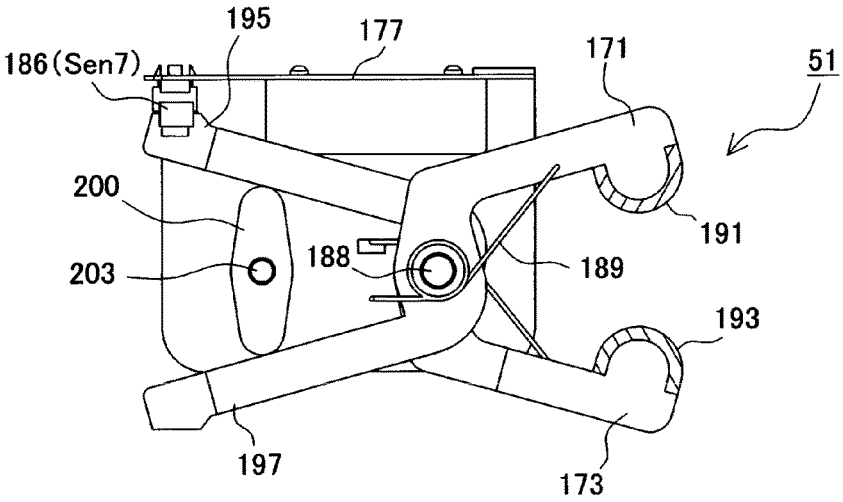
Figure 8C:
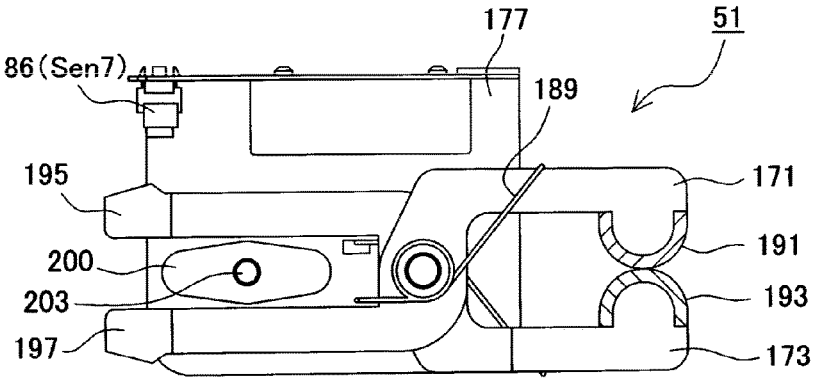

FIGS. 8A to 8C are views each illustrating the gripper member 51 of FIG. 7. FIG. 8A is a perspective view illustrating the grip release state, FIG. 8B is a view illustrating a mechanism of the gripper member 51 in the grip release state of FIG. 8A, and FIG. 8C is a view illustrating a mechanism of the gripper member 51 in the grip state where the gripper member 51 grips the folded sheet bundle BS.

As illustrated in FIG. 8A, the upper and lower grippers 171 and 173 configured to be openable/closable so as to grip the folded sheet bundle BS are turnably mounted to an arm shaft 188 of the arm frame 177 that supports the upper and lower grippers 171 and 173. A coil spring 189, whose one end is locked to the arm frame 177 and the other end is locked to the upper gripper 171, is wound around the arm shaft 188. Another coil spring 189 is locked to the lower gripper 173 in the same manner. The coil springs 189 always bias the upper and lower grippers 171 and 173, respectively, in their closing direction.

A gear frame 179 is provided at a side of the arm frame 177. In the gear frame 179, drive force of the gripper opening/closing motor 181 is transmitted to a gripper portion transmission gear 185 through a motor output shaft 183. The drive force is further transmitted from the gripper portion transmission gear 185 to the gripper opening/closing cam 200 through a cam gear 187. The arm frame 177 and the gear frame 179 constitute the gripper frame 175.

FIG. 8B illustrates a state where the grip state between the upper and lower grippers 171 and 173 is released by the opening/closing cam 200 against a biasing force of the coil springs 189. In this state, a lower gripper rear end 195 is detected by an opening/closing detection sensor (SEN7) 186 to thereby detect that the gripper member 51 is in the grip release state. When the gripper opening/closing motor 181 is driven in this state to rotate a cam shaft 203 in a clockwise direction in the drawing, the opening/closing cam 200 fixedly mounted to the cam shaft 203 is rotated in the same direction. As a result of the rotation of the opening/closing cam 200, the upper and lower grippers 171 and 173 are biased by the coil springs 189, respectively, in a direction approaching each other.

FIG. 8C illustrates a state where the upper and lower grippers 171 and 173 are released from the locking state by the opening/closing cam 200 and exclusively biased by the biasing force of the coil springs 189. In this state, the gripper member 51 grips a side portion of the folded sheet bundle BS and pulls the folded sheet bundle BS in the direction crossing the conveying direction of the relay roller 48.

Further, a press upper rubber 191 and a press lower rubber 193 are fitted to leading ends of the upper and lower grippers 171 and 173, respectively, thereby preventing slipping between the upper and lower grippers 171, 173 and folded sheet bundle BS or fall-off of the folded sheet bundle from the upper and lower grippers 171 and 173. When it is necessary to release the grip state of the gripper member 51, that is, when it is necessary to bring the gripper member 51 into the state illustrated in FIG. 8B from the state illustrated in FIG. 8C, the gripper opening/closing cam 200 is rotated in the clockwise direction.

[Support Unit]

Figure 9:
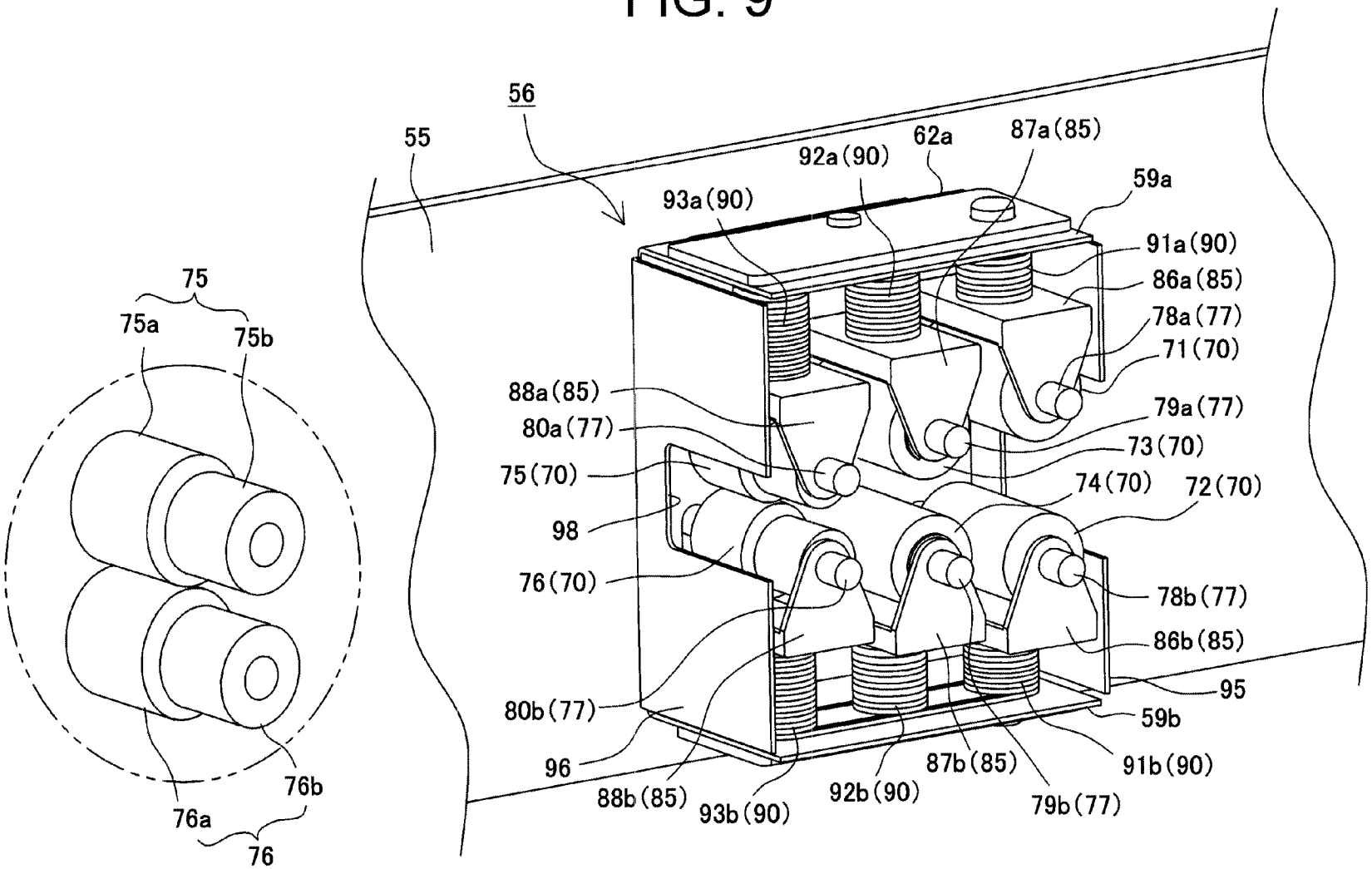
FIG. 9 is a perspective view, as viewed from a sheet carry-in side, of a state where a support unit supporting a plurality of rows of pressing roller pairs whose intervals in the respective rows are reduced stepwise in a moving direction of the folded sheet bundle is fixedly mounted to a device frame.
Figure 10:
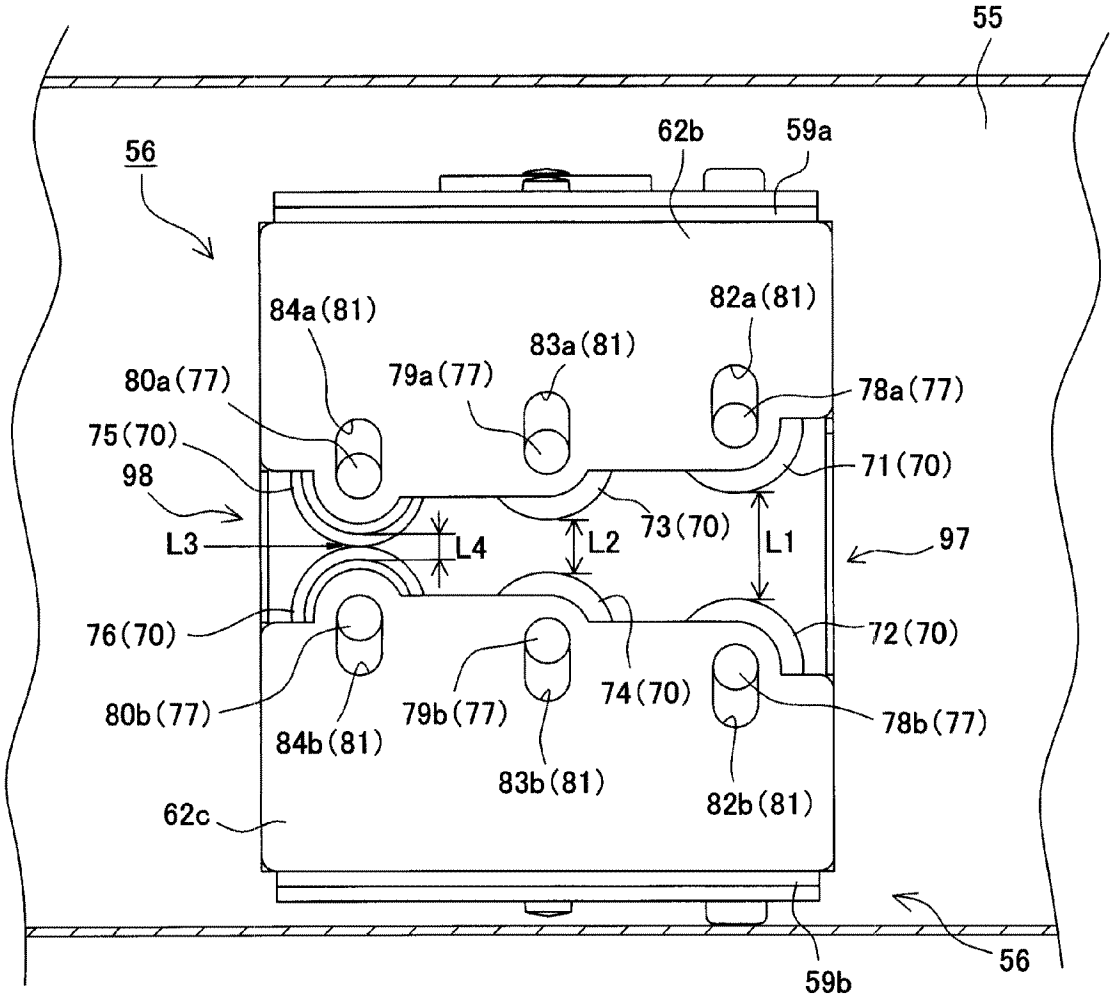
FIG. 10 is a front view of the support unit of FIG. 9 as viewed from the sheet carry-in side.

The following describes the support unit 56 supporting the pressing rollers 70 that press the folding loop of the folded sheet bundle BS pulled by the above-described gripper member 51 with reference to FIGS. 9 and 10. The support unit 56 is provided in a sheet discharge path extending in the direction crossing the conveying direction of the relay roller 48 and is fixedly mounted to the device frame 55 as a unit as illustrated in FIG. 9.

FIG. 9 is a perspective view of the support unit 56, and FIG. 10 is a front view of the support unit 56. The support unit 56 is surrounded by a unit base plate 62*a* constituting a back surface side of the unit, front upper and lower base plates 62*b* and 62*c* which are separated up and down, a preceding unit side plate 95, a following unit side plate 96, a unit top plate 59*a*, and a unit bottom plate 59*b*. The preceding unit side plate 95 has a preceding side plate opening 97 having a comparatively large size, and the following unit side plate 96 has a following side plate opening 98 having a size smaller than the preceding side plate opening 97. These openings 97 and 98 allow the folding loop of the folded sheet bundle to be inserted into the support unit 56 upon movement of the folding loop.

As illustrated in detail in FIG. 9, inside the support unit 56, a plurality of rows (in the present embodiment, three rows) of pressing roller pairs 70 are arranged from the preceding unit side plate 95 side toward the following unit side plate 96. An interval between the pair of pressing rollers 70 differs among the rows. That is, the pressing rollers 70 of a first row include a first upper pressing roller 71 and a first lower pressing roller 72 which are disposed opposite to each other with a sheet fold position as a center at positions substantially equally distant from the sheet fold position and spaced apart from each other by a predetermined interval. The first upper and lower pressing rollers 71 and 72 have a first upper pressing roller shaft 78*a* and a first lower pressing roller shaft 78*b*, respectively. The first upper and lower pressing roller shafts 78*a* and 78*b* are supported by a first upper pressing roller bracket 86*a* and a first lower pressing roller bracket 86*b*, respectively. The first upper pressing roller bracket 86*a* is vertically movably supported by the unit top plate 59*a*, and the first lower pressing roller bracket 86*b* is vertically movably supported by the unit bottom plate 59*b*.

Further, a first upper pressing roller pressing spring 91*a* is interposed between the first upper pressing roller bracket 86*a* and the unit top plate 59*a* so as to bias the first upper pressing roller bracket 86*a* and unit top plate 59*a* in a direction separating them from each other; similarly, a first lower pressing roller pressing spring 91*b* having the same function as the first upper pressing roller pressing spring 91*a* is interposed between the first lower pressing roller bracket 86*b* and the unit bottom plate 59*b*. With this configuration, the first upper pressing roller 71 and first lower pressing roller 72 are always biased in a direction approaching each other. On the other hand, a first upper pressing roller shaft elongated hole 82*a* is formed in the unit base plate 62*a* and the front upper base plate 62*b* that support the first upper pressing roller shaft 78*a*.

Thus, the biasing force of the first upper pressing roller pressing spring 91*a* is regulated by the first upper pressing roller shaft elongated hole 82*a*. Further, the biasing force of the first lower pressing roller pressing spring 91*b* is regulated by a first lower pressing roller shaft elongated hole 82*b*, and upward movement of the first lower pressing roller 72 is also regulated by the first lower pressing roller shaft elongated hole 82*b*. Thus, as illustrated in detail in FIG. 10, an interval L1 between the first upper pressing roller 71 and the first lower pressing roller 72 is always kept constant. In the present embodiment, the interval L1 is set to about 14 mm. Further, the first upper pressing roller pressing spring 91*a* and the first lower pressing roller pressing spring 91*b* are set so as to apply a load of 4.0 kg to the first upper and lower pressing rollers 71 and 72 in a state where the rollers 71 and 72 are brought into contact with each other.

As can be seen well from FIGS. 9 and 10, the pressing roller pair 70 of a second row has the same configuration as that of the pressing roller pair 70 of the first row.

That is, the pressing rollers 70 of the second row include a second upper pressing roller 73 and a second lower pressing roller 74 which are disposed opposite to each other and spaced apart from each other by a predetermined interval. The second upper and lower pressing rollers 73 and 74 have a second upper pressing roller shaft 79*a* and a second lower pressing roller shaft 79*b*, respectively. The second upper and lower pressing roller shafts 79*a* and 79*b* are supported by a second upper pressing roller bracket 87*a* and a second lower pressing roller bracket 87*b*, respectively. The second upper pressing roller bracket 87*a* is vertically movably supported by the unit top plate 59*a*, and the second lower pressing roller bracket 87*b* is vertically movably supported by the unit bottom plate 59*b*.

Further, a second upper pressing roller pressing spring 92*a* is interposed between the second upper pressing roller bracket 87*a* and the unit top plate 59*a* so as to bias the second upper pressing roller bracket 87*a* and the unit top plate 59*a* in a direction separating them from each other; similarly, a second lower pressing roller pressing spring 92*b* having the same function as the second upper pressing roller pressing spring 92*a* is interposed between the second lower pressing roller bracket 87*b* and the unit bottom plate 59*b*.

With this configuration, the second upper pressing roller 73 and the second lower pressing roller 74 are always biased in a direction approaching each other. On the other hand, a second upper pressing roller shaft elongated hole 83*a* is formed in the unit base plate 62*a* and the front upper base plate 62*b* that support the second upper pressing roller shaft 79*a*. Thus, the biasing force of the second upper pressing roller pressing spring 92*a* is regulated by the second upper pressing roller shaft elongated hole 83*a*, and downward movement of the second upper pressing roller 73 is also regulated by the second upper pressing roller shaft elongated hole 83*a*.

Further, the biasing force of the second lower pressing roller pressing spring 92*b* is regulated by a second lower pressing roller shaft elongated hole 83*b*, and upward movement of the second lower pressing roller 74 is also regulated by the second lower pressing roller shaft elongated hole 83*b*. Thus, as illustrated in detail in FIG. 10, an interval L2 between the second upper pressing roller 73 and second lower pressing roller 74 is always kept constant. In the present embodiment, the interval L2 is set to about 7 mm. Further, the second upper pressing roller pressing spring 92*a* and the second lower pressing roller pressing spring 92*b* are set so as to apply a load of 4.0 kg to the second upper and lower pressing rollers 73 and 74 in a state where the rollers 73 and 74 are brought into contact with each other.

Further, as can be seen well from FIGS. 9 and 10, the pressing roller pair 70 of a third row has the same configuration as those of the pressing roller pairs 70 of the respective first and second rows, so descriptions of the pressing roller pair 70 of the third row will be omitted here, and only a different point will be described.

That is, the first upper and second pressing rollers 71 and 72 of the first row are separated from each other by the predetermined interval L1 (in the present embodiment, about 14 mm) as illustrated in FIG. 7; similarly, the second upper and second pressing rollers 73 and 74 of the second row are separated from each other by the predetermined interval L2 (in the present embodiment, about 7 mm). This is because the first upper pressing roller shaft elongated hole 82*a*, the first lower pressing roller shaft elongated hole 82*b*, the second upper pressing roller shaft elongated hole 83*a*, and the second lower pressing roller shaft elongated hole 83*b* serve as an interval regulating member. Thus, by the above elongated holes, the pair of the pressing rollers are position-regulated so as to prevent the interval therebetween from being made smaller than the predetermined interval.

On the other hand, third upper and lower pressing rollers 75 and 76 of the third row are always elastically biased so as to be brought into pressure contact with each other. That is, a third upper pressing roller shaft elongated hole 84*a* and a third lower pressing roller shaft elongated hole 84*b* are formed such that a roller interval L3 is 0. A third upper pressing roller pressing spring 93*a* and a third lower pressing roller pressing spring 93*b* are set so as to apply a load of 4.0 kg to the third upper and lower pressing rollers 75 and 76 at the roller contact position. With this configuration, the sheet pressing is performed while a load exceeding 4 kg is applied to both sides of the fold of the folded sheet bundle BS.

Further, as illustrated in FIG. 9 and in a part surrounded by a long dashed double-short dashed circle of FIG. 9, the pair of third upper and lower pressing rollers 75 and 76 have a first region R1 (hereinafter, referred to as "region R1") where an upper roller large-diameter portion 75*a* and a lower roller large-diameter portion 76*a* are brought into pressure contact with each other and a second region R2 (hereinafter, referred to as "region R2") where an upper roller small-diameter portion 75*b* and a lower roller small-diameter portion 76*b* are opposed to each other with a slight gap. The regions R1 and R2 are adjacently arranged from the downstream side to upstream side in this order in the sheet bundle carry-in direction. This stepped roller pair is integrally formed as illustrated and is configured to be rotatable. With this configuration, a gap is provided between the third upper and lower pressing rollers 75 and 76, so that impact applied when the folded sheet bundle BS is introduced between the rollers 75 and 76 can be reduced.

As described above, the pressing rollers 70 as a sheet pressing member of the present invention include the first, second, and third upper pressing rollers 71, 73, and 75 and the first, second, and third lower pressing rollers 72, 74, and 76 which are disposed opposite respectively to the pressing rollers 71, 73, 75. The above pressing rollers 70 of a plurality of rows (in the present embodiment, three rows) are unitized as the support unit 56, and the support unit 56 is fixedly mounted to the device frame 55. Further, the above pressing rollers 70 can be rotated in the moving direction thereof. The folded sheet bundle BS is moved by being pulled by the gripper member 51 along the fold. In the movement, the folded sheet bundle BS first passes between the first upper and lower pressing rollers 71 and 72 of the first row, the interval between which is largest. The interval between the second upper and lower pressing rollers 73 and 74 of the last row but one (in the present embodiment, second row) is made smaller.

Then, the third upper and lower pressing rollers 75 and 76 of the third row (last row in the moving direction) are configured to press, at the region R1 corresponding to the large-diameter portion, the folded sheet bundle BS from both sides with a spring force of 4 kg. As described above, a plurality of rows of pressing roller pairs 70 are arranged such that the intervals between the pair of pressing rollers 70 of the respective rows are reduced from the first row in the moving direction toward the last row.

That is, in the present embodiment, the intervals between the pressing rollers of the respective rows are reduced stepwise from the first row to the last row. With this configuration, the folded sheet bundle BS is moved while the fold thereof is pressed by the pressing rollers of three rows arranged and supported in one unit from both sides thereof. Through this process, stepwise pressing is applied to the folded sheet bundle BS. Further, in the above sheet pressing, the pressing rollers of each row are configured to press the folded sheet bundle BS from both sides in a thickness direction of the folding loop with the pressing position set at a center of each roller pair.

[Movement/Operation of Gripper Member]

The following describes, with reference to FIGS. 11 to 16, movement/operation of the gripper member 51 that moves (pulls) the folding loop of the folded sheet bundle BS to the support unit 56 in the sheet pressing device 50 for stepwise pressing.

Figure 11:
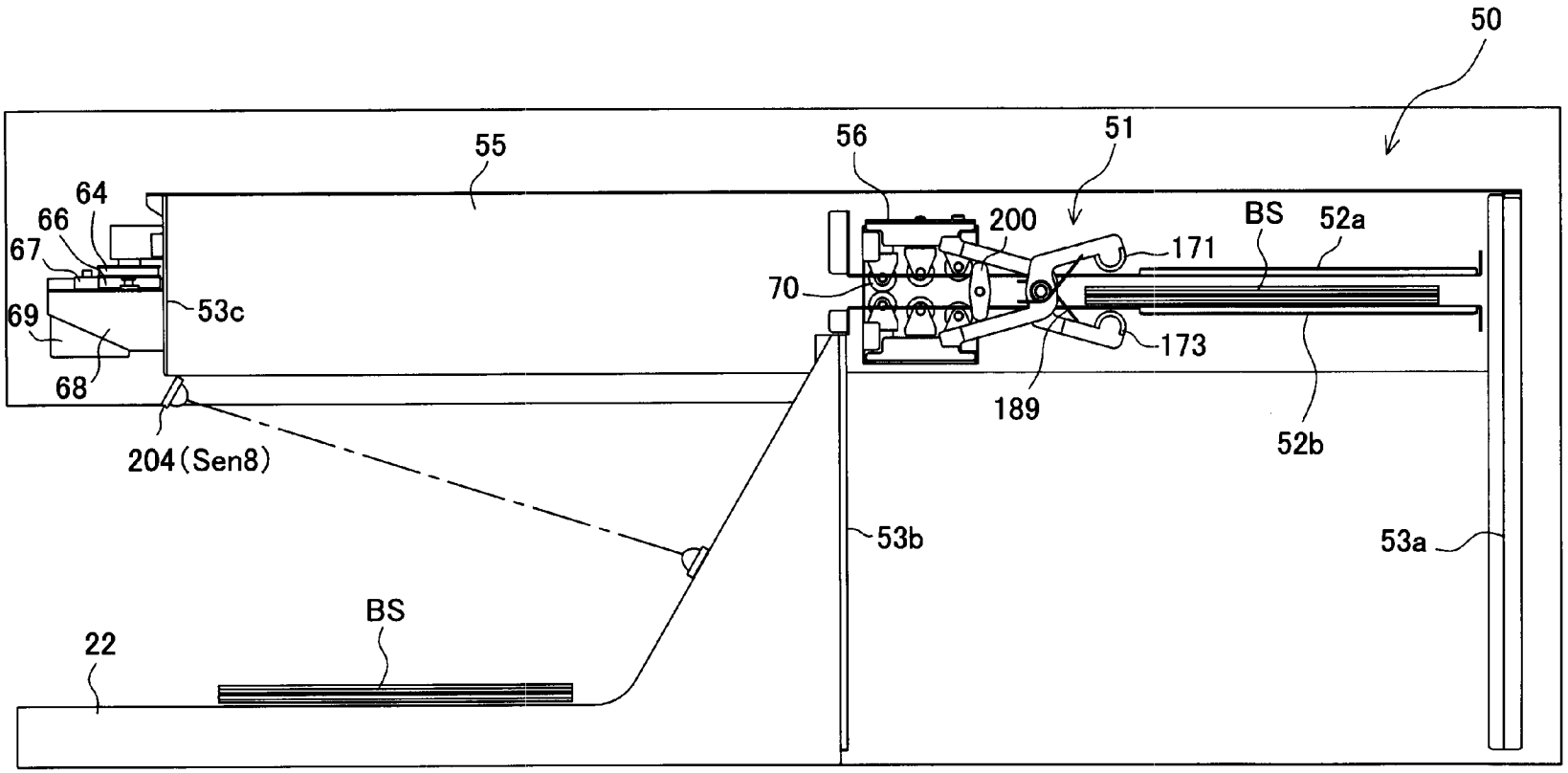
FIG. 11 is a view illustrating operation of the sheet pressing device of FIGS. 6 and 7 and illustrating a state where the gripper member waits for carry-in of the folded sheet bundle having the folding loop conveyed by the folding roller and the relay roller so as to move the folded sheet bundle in the orthogonal direction to the conveying direction of the folding roller and the relay roller.

FIG. 11 is a view illustrating a state where the gripper member in an open state waits for carry-in of the folded sheet bundle BS having the folding loop conveyed by the folding roller 45 and the relay roller 48 so as to move the folded sheet bundle in the orthogonal direction to the conveying direction of the folding roller 45 and the relay roller 48. In this state, the opening/closing cam 200 is positioned vertically, and the upper and lower grippers 171 and 173 are opened against the biasing force of the coil springs 189. The folded sheet bundle BS is conveyed between the opened upper and lower grippers 171 and 173 with the folding loop as the head.

Figure 12:
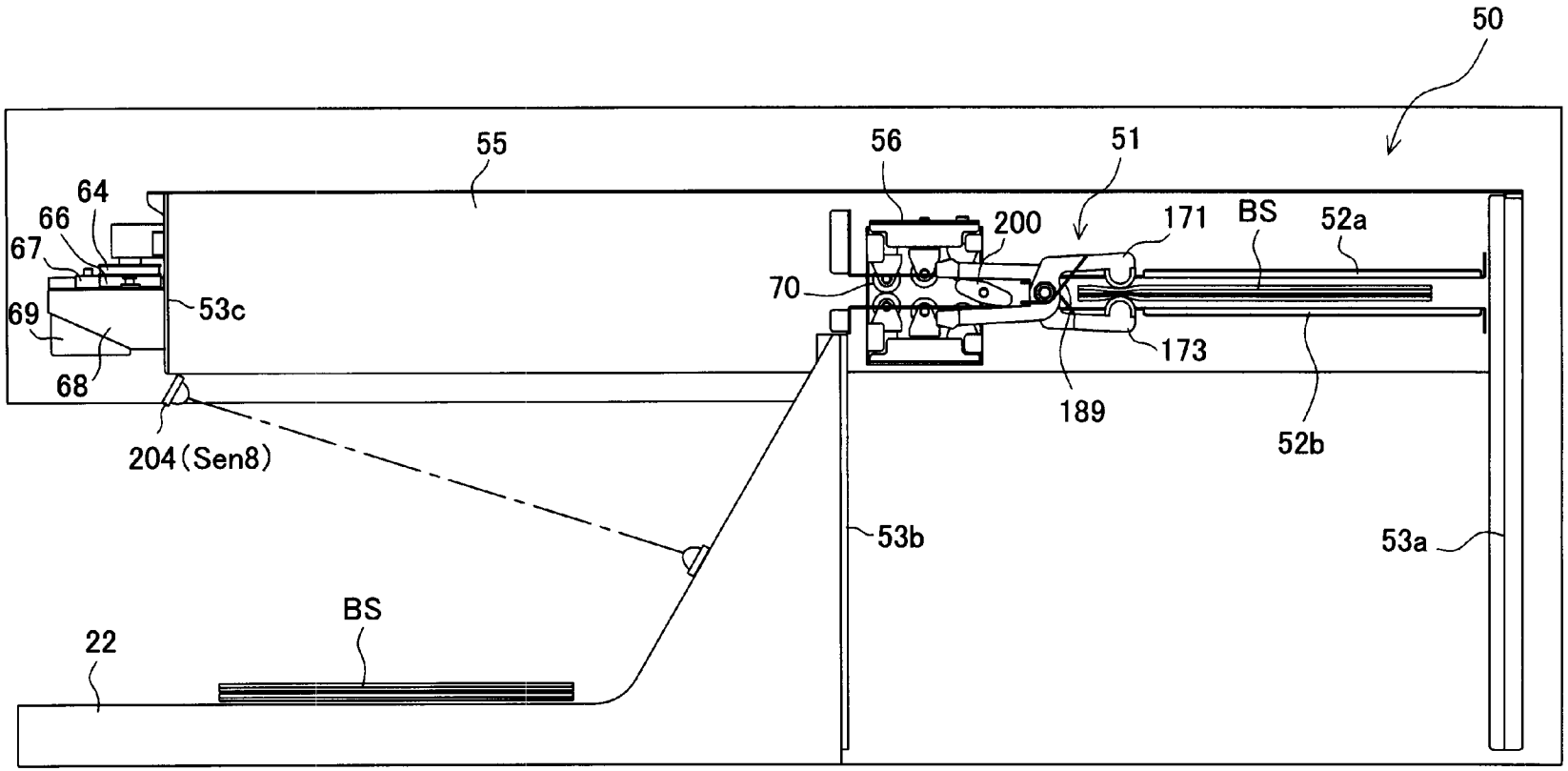
FIG. 12 is a view continuing from FIG. 11, illustrating a state where the gripper member grips the carried-in folded sheet bundle.

Then, in a state of FIG. 12, movement of the folded sheet bundle BS is stopped at a position where the folding loop is closest to the device frame 55, and then the upper and lower grippers 171 and 173 are used to grip a slightly upstream side portion of the folding loop of the folded sheet bundle BS so as to leave the folding loop. In this state, the opening/closing cam 200 is positioned horizontally to cause the upper and lower grippers 171 and 173 to grip the side of the folded sheet bundle BS with the biasing force of the coil springs 189.

Figure 13:
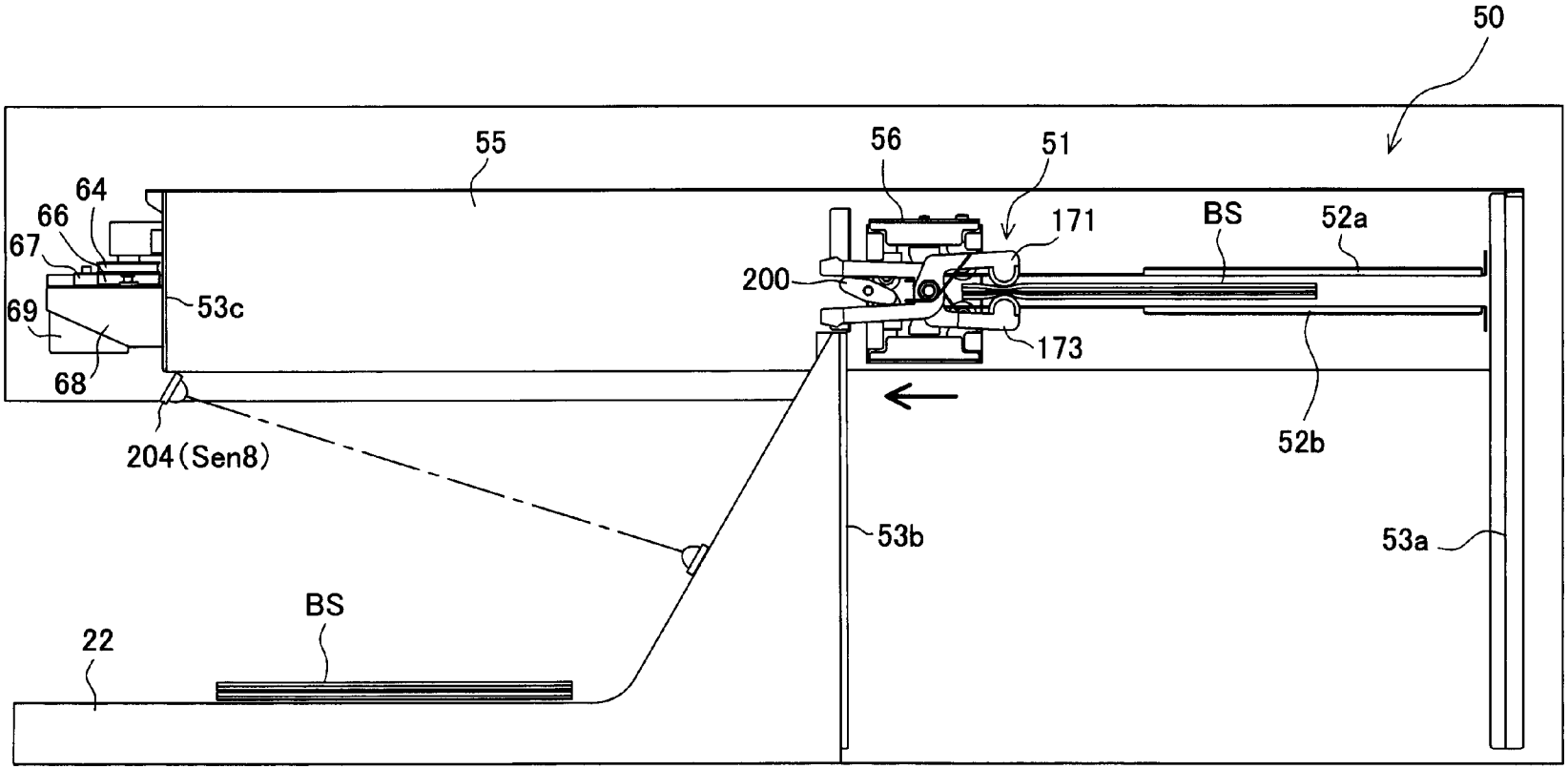
FIG. 13 is a view continuing from FIG. 12, illustrating a state where the gripper member grips the folded sheet bundle and pulls it into the support unit supporting the pressing rollers.

FIG. 13 is a view illustrating a state where the gripper member moving motor 69 is driven to cause the gripper member 51 to pull the folded sheet bundle BS toward the second sheet discharge tray 22 (in a direction indicated by an arrow in FIG. 13). As illustrated in FIG. 13, the leading end loop portion of the folded sheet bundle BS is carried into the support unit 56 supporting the pressing rollers 70.

Figure 14:
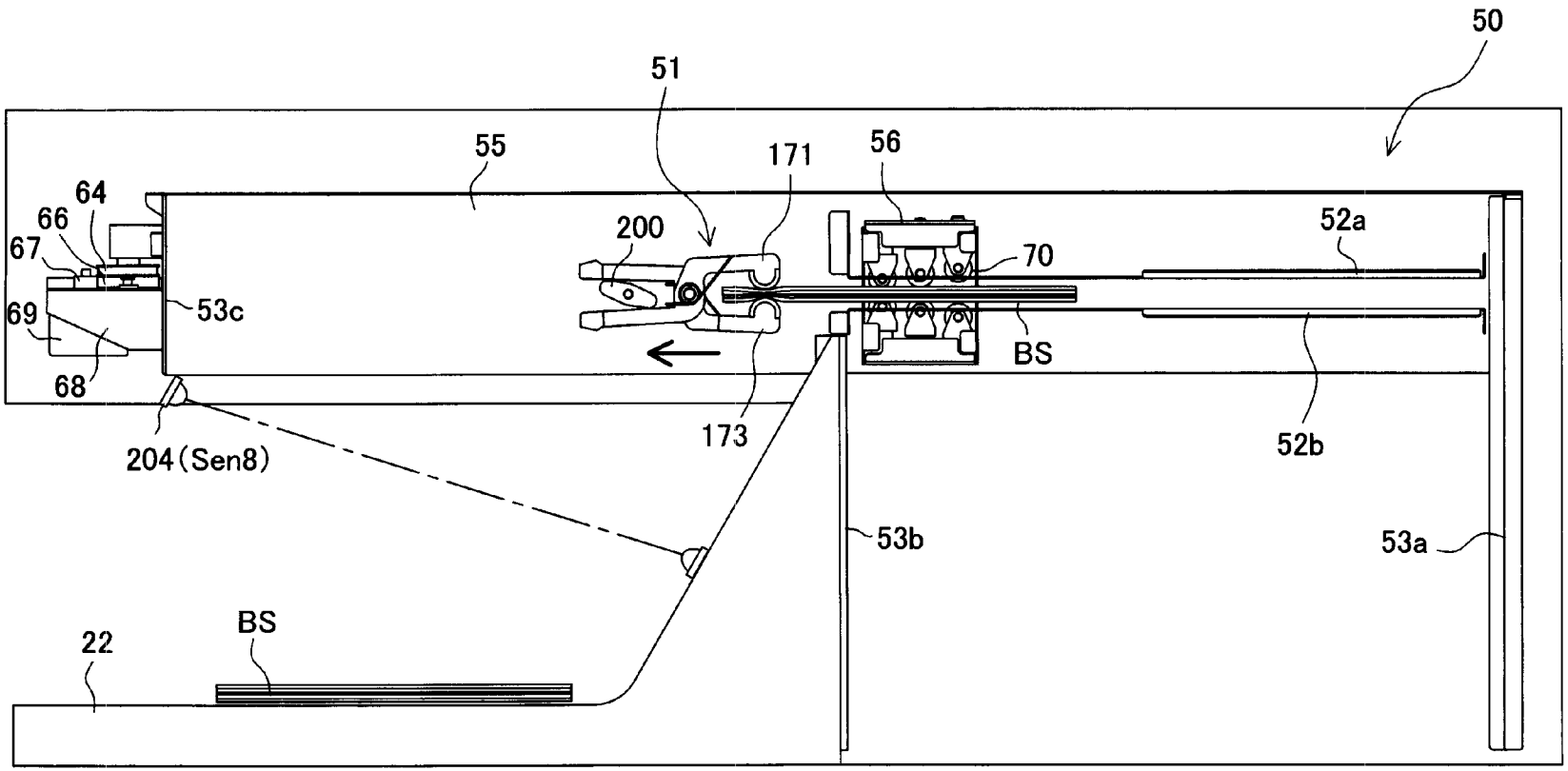
FIG. 14 is a view continuing from FIG. 13, illustrating a state where the loop portion of the folded sheet bundle is made to pass through the support unit by the gripper member gripping the folded sheet bundle while being pressed by the pressing rollers.

FIG. 14 is a view illustrating a state where the gripper member 51 continues moving above the second sheet discharge tray 22 while gripping the folded sheet bundle BS. In this state, the loop portion of the folded sheet bundle BS is passing between the third upper and lower pressing rollers of the support unit 56 having the mutually pressure contact region. This pressing is performed in a conveying course of the folded sheet bundle BS to the second sheet discharge tray 22, so that it is not necessary to stop the conveyance of the folded sheet bundle BS.

Figure 15:
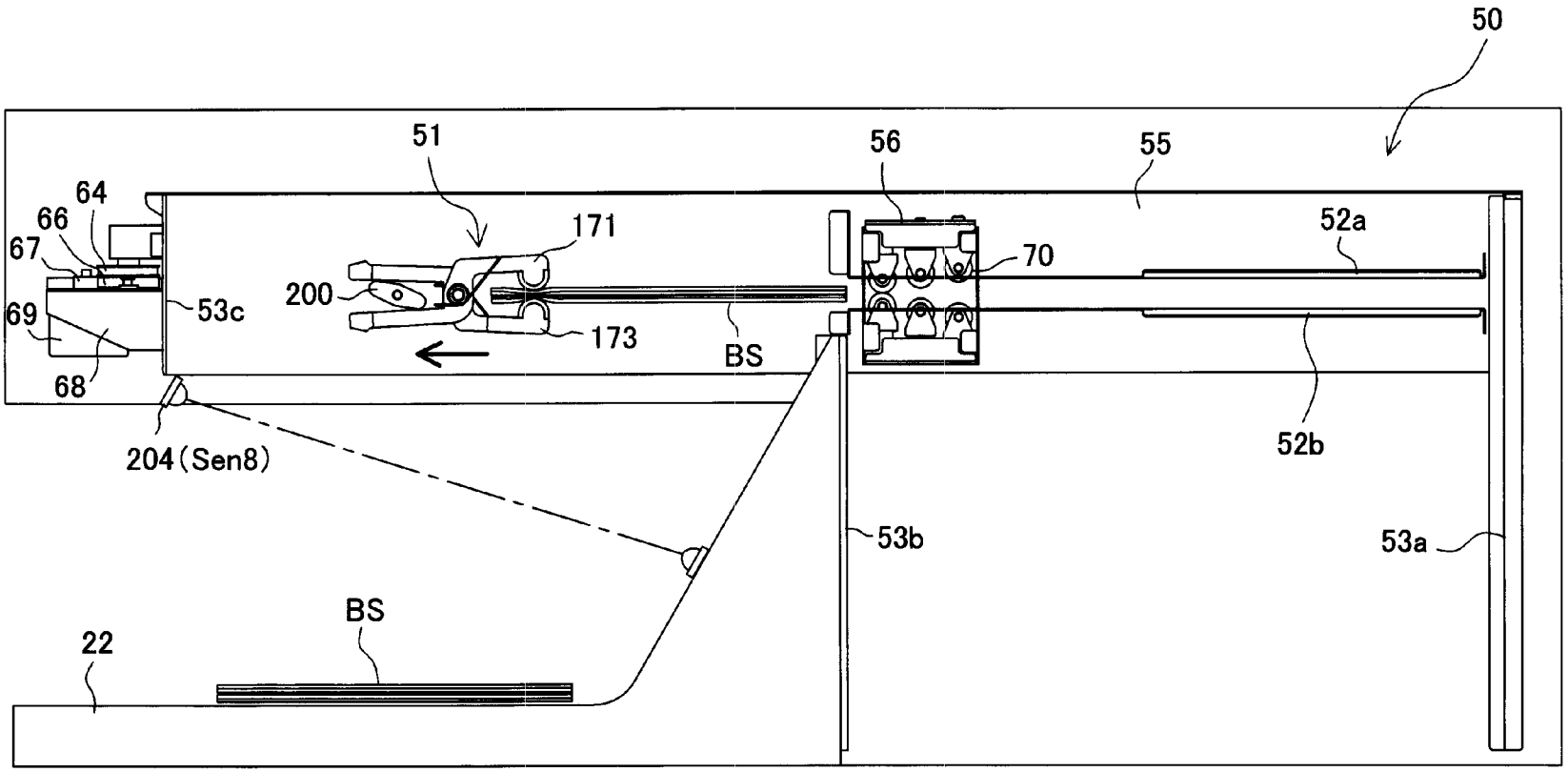
FIG. 15 is a view continuing from FIG. 14, illustrating a state where the loop portion of the folded sheet bundle gripped by the gripper member has passed through the support unit.

FIG. 15 is a view illustrating a state where the gripper member 51 moves further to the left in the drawing while gripping the folded sheet bundle BS with the result that the loop portion of the folded sheet bundle BS has passed through between the pressing roller pairs 70 of the support unit 56. That is, in this state, the sheet pressing has been applied to the folding loop portion by the pressing rollers 70 of three rows. This point will be described later.

Figure 16:
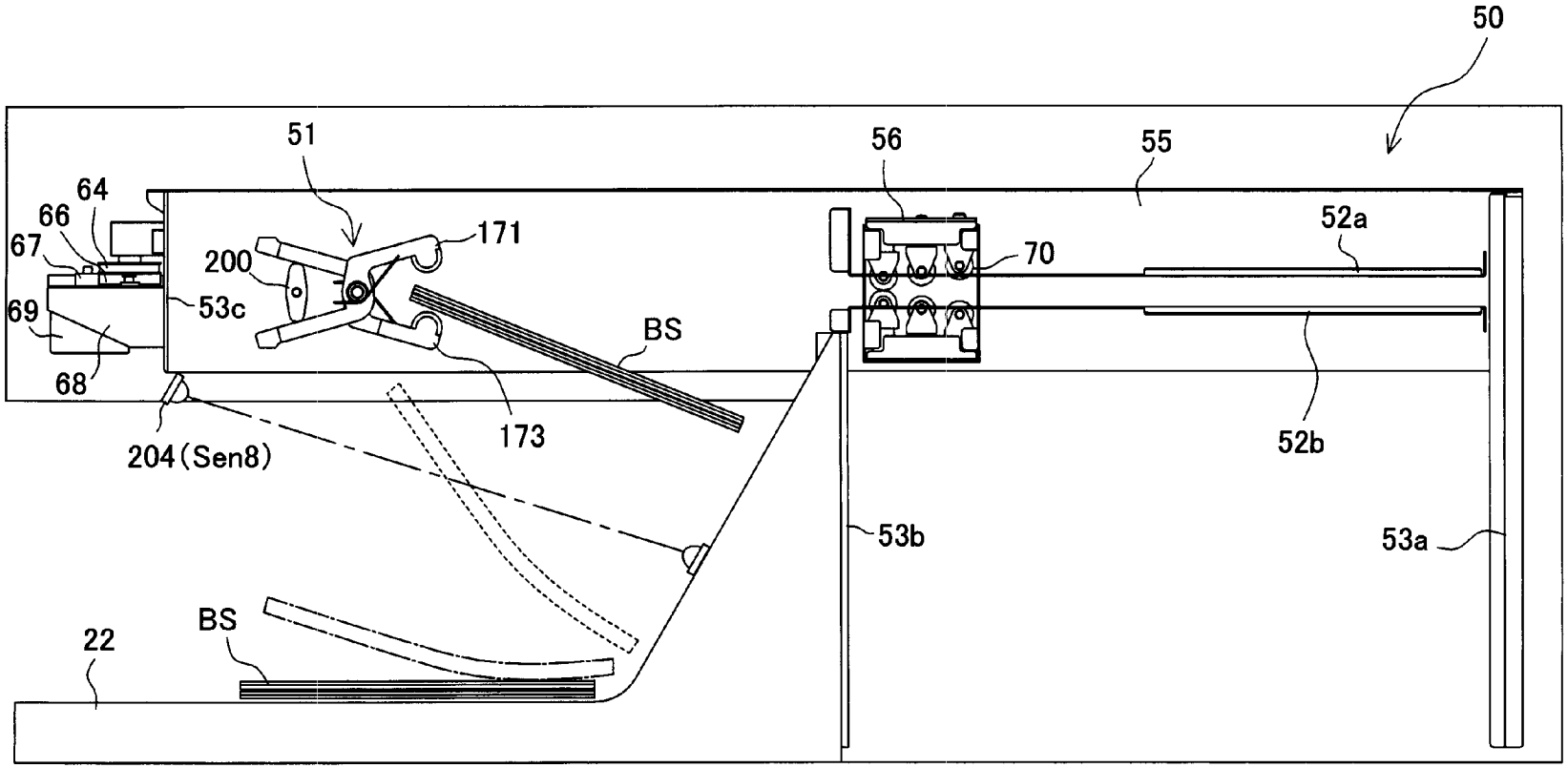
FIG. 16 is a view continuing from FIG. 15, illustrating a state where the gripper is stopped and brought into a grip release state so as to discharge the folded sheet bundle to the second sheet discharge tray.

FIG. 16 is a view illustrating a state where the gripper member 51 moves further to the left in the drawing, and the opening/closing cam 200 is positioned vertically by the gripper opening/closing motor 181. As a result, the upper and lower grippers 171 and 173 are in an opened state to release the grip state. With this operation, the folded sheet bundle BS that has been subjected to the pressing is discharged/dropped to the second sheet discharge tray 22.

The discharge of the folded sheet bundle BS to the second sheet discharge tray 22 can be detected by ON/OFF of the bundle discharge sensor (SEN8) 204. When the detection of the discharge is not made even after the release of the grip state of the gripper member 51, the discharge is confirmed by rotating the opening/closing cam 200 to open/close and vibrate the upper and lower grippers 171 and 173. If the bundle discharge sensor (SEN8) 204 is not turned ON/OFF even after this operation, it is determined that the folded sheet bundle BS is caused inside the device or the second sheet discharge tray 22 is full, and error display is made.

[Sheet Pressing Process]

Figure 17:
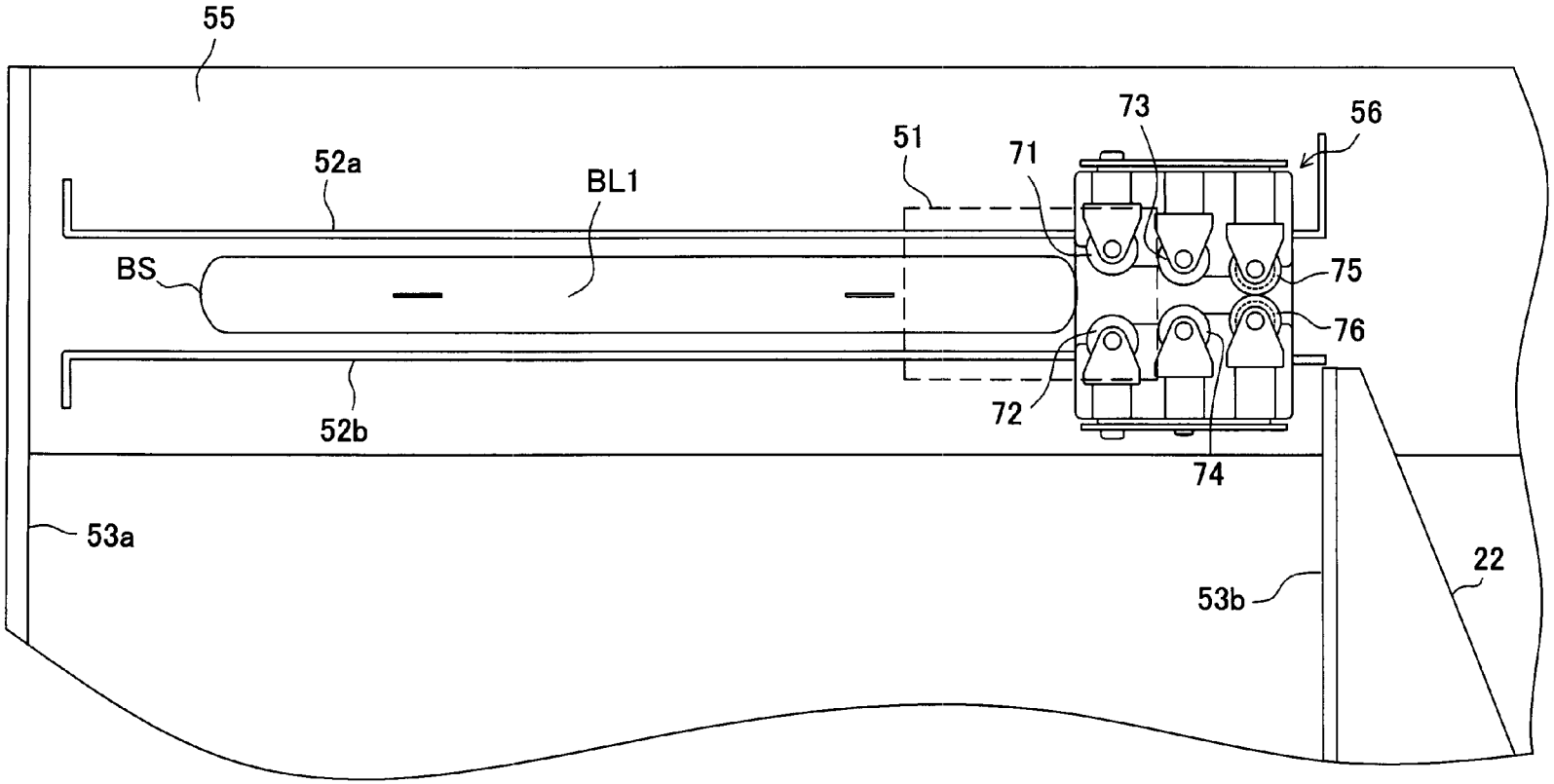
FIG. 17 is a view illustrating, with the device frame to which the support unit supporting the pressing rollers is fixedly mounted made transparent, a state where the loop portion of the folded sheet bundle is positioned at a side of the support unit.
Figure 18:
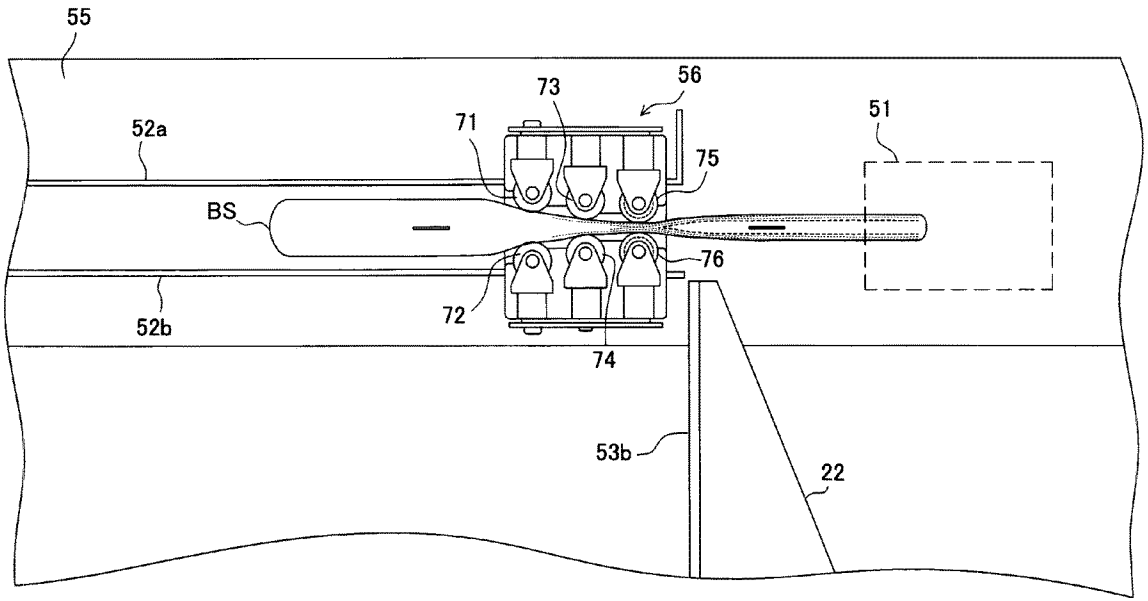
FIG. 18 is a view continuing from FIG. 17, illustrating a state where the sheet pressing by the plurality of rows of pressing roller pairs whose interval differs among the rows has been executed up to about a middle portion of the folding loop in the width direction of the folded sheet bundle.
Figure 19:
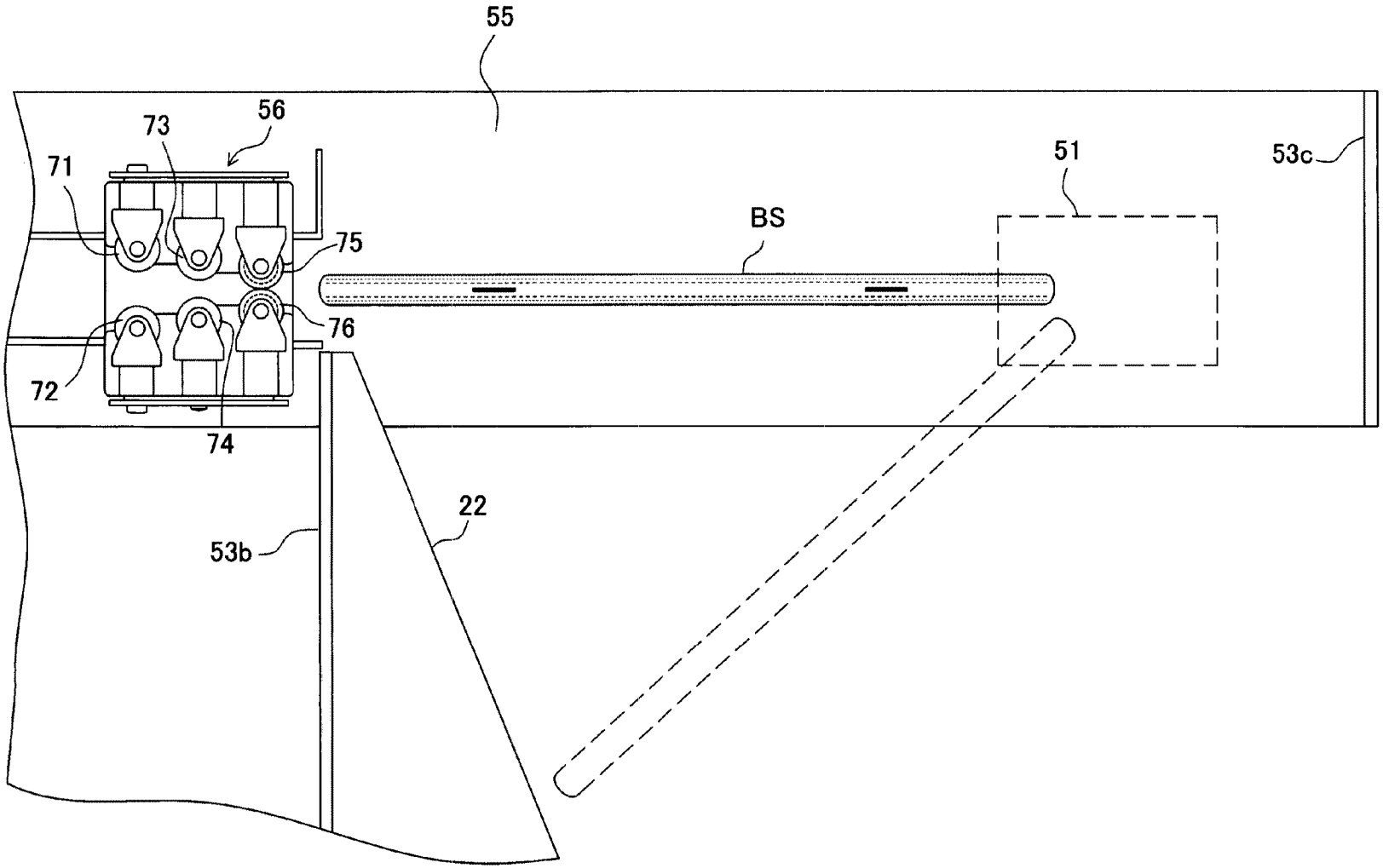
FIG. 19 is a view continuing from FIG. 19, illustrating a state where the folding loop portion has passed through the support unit and the sheet pressing is completed.

The following describes, with reference to FIGS. 17 to 19, a state where the sheet pressing is applied to the loop portion of the folded sheet bundle BS pulled by the gripper member 51. In FIGS. 17 to 19, an engagement between the pressing rollers 70 of the support unit 56 and folding loop is illustrated with the device frame 55 to which the support unit 56 is fixedly mounted made transparent for descriptive convenience. Further, with reference to FIGS. 20A to 20D, a pressed state of the folding loop having folding lines created by the pressing rollers 20 will be described.

When the folding loop of the folded sheet bundle BS becomes a predetermined size (in the present embodiment, 22 mm in the vertical direction of the loop), the folding roller 45 and the relay roller 48 are stopped, and the folded sheet bundle BS is gripped by the gripper member 51 and moved in a direction crossing the direction in which it has been conveyed. By this movement, the folding loop portion of the folded sheet bundle passes through the support unit 56. FIG. 17 illustrates a state where the movement in the crossing direction is started, that is, a state immediately before insertion of the folded sheet bundle BS into the support unit 56. This state corresponds to a state slightly before the state of FIG. 13.

FIG. 18 illustrates a state where the gripper member 51 moves to a position above the second sheet discharge tray 22 while gripping the folded sheet bundle BS. This state corresponds to the state of FIG. 14.

In this state, the folded sheet bundle BS is moved along the fold (sheet width direction) thereof where the loop is formed by the folding roller 45 while being pressed from both sides in the folding loop thickness direction (in the vertical direction crossing the folded sheet bundle BS conveying direction) by the first upper and lower pressing rollers 71 and 72 as the pressing member for pressing the folded sheet bundle BS, whereby a plurality of folding lines are created on the folded sheet bundle BS.

Figure 20A:
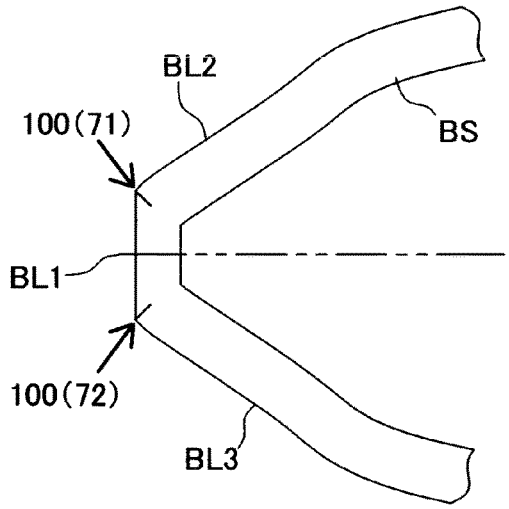
Figure 20B:
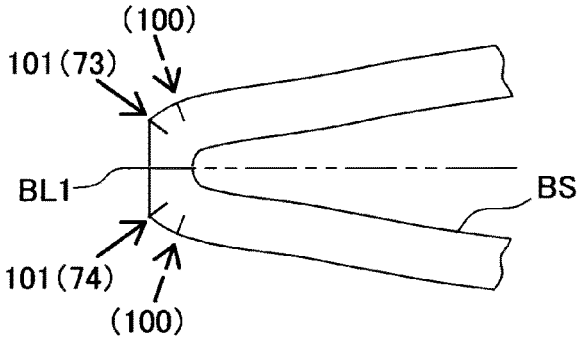
Figure 20C:
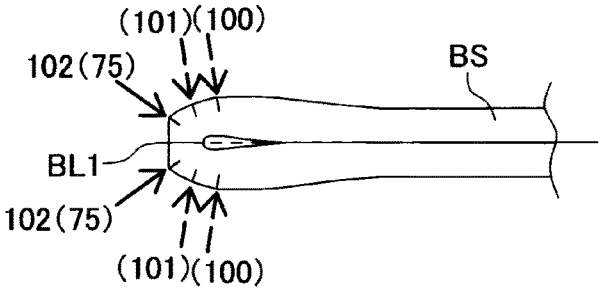
Figure 20D:
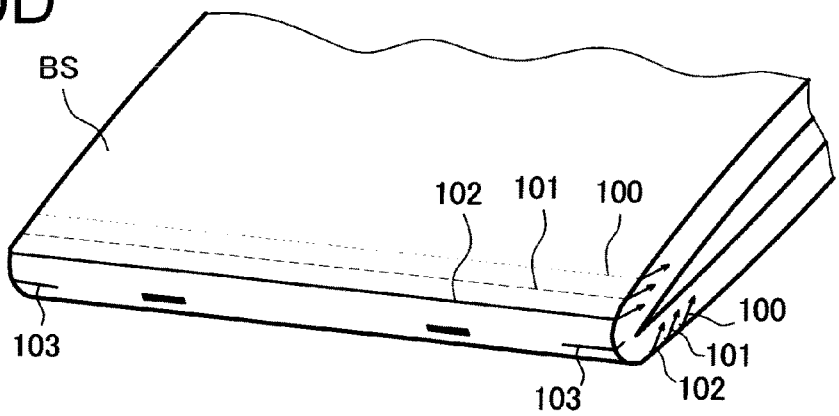

That is, the interval between the first upper and lower pressing rollers 71 and 72 of a first step is set to a value (in the present embodiments, about 14 mm relative to the loop size (height) of 22 mm) slightly smaller than a size of the folding loop, and the folded sheet bundle BS is moved along the fold thereof created by the folding roller 45 to thereby create a first-step fold. The first-step fold is illustrated as a first fold line 100 indicated by a solid arrow in FIG. 20A. In FIG. 20D, this first fold line 100 is represented by a light line on the folded sheet bundle BS. That is, as illustrated in FIG. 20A, a part of the folding loop that is pressed by the first upper and lower pressing rollers 71 and 72 is applied with a concentrated load, causing buckling in the folded sheet bundle BS, and by the movement of the folded sheet bundle BS between the first upper and lower pressing rollers 71 and 72 in the width direction, the buckled part appears as the first fold line 100.

In a second step, the interval between the second upper and lower pressing rollers 73 and 74 as the sheet bundle pressing member is set to a value (in the present embodiments, about 7 mm) slightly smaller than the size of the loop pressed in the first step, and the folded sheet bundle BS is moved along the fold thereof created by the folding roller 45 to thereby create a second-step fold. The second fold is illustrated as a second fold line 101 positioned on a back side of the first fold line 100 and indicated by a solid arrow in FIG. 20B. In FIG. 20D, this second fold line 101 is represented by a light line on the folded sheet bundle BS. That is, a part of the loop that is pressed by the second upper and lower pressing rollers 73 and 74 is applied with a concentrated load, causing buckling in the folded sheet bundle BS, and by the movement of the folded sheet bundle BS between the second upper and lower pressing rollers 73 and 74 in the width direction, the buckled part appears as the second fold line 101.

The third upper and lower pressing rollers 75 and 76 as the sheet bundle pressing member of the final step are brought into pressure contact with each other by the elastic force of the third upper and lower pressing roller pressing springs 93*a* and 93*b*. In the final step, unlike the first and second steps, no interval is provided between the third upper and lower pressing rollers 75 and 76 (in the present embodiments, interval between the large-diameter rollers is set to 0). Thus, in the final step, the folding loop is moved, while being pressed by the third upper and lower pressing rollers 75 and 76 at a position corresponding to the thickness of the folded sheet bundle BS that has been pressed in the first and second steps. The fold created by the pressing rollers 70 of the final step is illustrated as a final fold line 102 indicated by a solid arrow in FIG. 20C. In FIG. 20D, this final fold line 102 is represented by a comparatively dark line on the folded sheet bundle BS.

At end portions of the folded sheet bundle BS in the width direction, end portion folds 103 created when the folding roller 45 and the pressing rollers 70, which are brought into a pressure contact state, override the folded sheet bundle BS are formed. A part that is pressed between the third upper and lower pressing rollers 75 and 76, which are brought into a substantially pressure contact state, appears as an enhanced fold, i.e., the final fold line 102.

As described above, the pressing roller pairs 70 having different intervals among the rows are used to buckle the folded sheet bundle BS to create the folds. As a result, a folding direction is directed to a closing direction (line extending in the conveying direction that passes the fold) of the folded sheet bundle BS at the respective positions of the first fold line 100 (indicated by the light line) of the first step, the second fold line 101 (indicated by the light line) of the second step, and the final fold line 102 (indicated by the comparatively dark line) of the final step generated in accordance with the thickness of the folded sheet bundle BS. With this configuration, it is possible to prevent the folded sheet bundle BS from being opened to thereby prevent degradation of aligning property and accumulating property.

[Stepped Roller of Last Row]

The following describes a configuration of the stepped rollers mentioned in FIGS. 9 and 10, i.e., opposing third upper and lower pressing rollers 75 and 76 which are positioned in the last row of the support unit 56.

In a case where the folded sheet bundle BS is formed by a comparatively large number of sheets and is thus thick, when the end portion of the folded sheet bundle BS in the width direction enters between the third upper and lower pressing rollers 75 and 76 which are brought into pressure contact with each other, it abuts against and collides with the rollers 75 and 76 to be damaged. Further, when the impact of the collision is large, a position of the folded sheet bundle BS retained by the folding roller 45 or the relay roller 48 may be deviated from a proper position, or the folded sheet bundle BS may come off the folding roller 45 or the relay roller 48.

In order to cope with this problem, in the present embodiment, the third upper pressing roller 75 of the last row includes the upper roller large-diameter portion 75*a* and the upper roller small-diameter portion 75*b* disposed adjacent to the upper roller large-diameter portion 75*a* upstream thereof in the sheet carry-in direction, and the third lower pressing roller 76 includes the lower roller large-diameter portion 76*a* and the lower roller small-diameter portion 76*b*, as illustrated in a part surrounded by a long dashed double-short dashed circle of FIG. 9. The upper roller large-diameter portion 75*a* and the lower roller large-diameter portion 76*a* constitute the region R1 where they are brought into pressure contact with each other, and the upper roller small-diameter portion 75*b* and the lower roller small-diameter portion 76*b* constitute the region R2 where they are opposed to each other with a slight gap. The upper pressing roller 75 and the lower pressing roller 76 are each integrally formed as a stepped roller.

Thus, as illustrated in FIG. 10, in the region R1 where the upper roller large-diameter portion 75*a* and the lower roller large-diameter portion 76*a* are brought into pressure contact with each other, the interval L3 is 0, while in the region R2, a interval between the upper roller small-diameter portion 75*b* and the lower roller small-diameter portion 76*b* is set to L4 (about 2 mm, in the present embodiment). The interval L4 may be set to about 2 mm to about 4 mm, depending upon the number or a thickness of the sheets to be used. When the number of sheets exceeds a comparative large number (in the present embodiment, 15 sheets (30 sheets in a folded state, which corresponds to about 3 mm or more in thickness)), the fold of the folded sheet bundle BS is positioned to the region R2 of the upper roller small-diameter portion 75*b* and the lower roller small-diameter portion 76*b*; on the other hand, when the number of sheets is small (in the present embodiment, 15 sheets or less, the fold of the folded sheet bundle BS is positioned to the region R1 where the upper roller large-diameter portion 75*a* and the lower roller large-diameter portion 76*a* are brought into pressure contact with each other. With this configuration, even the end portion of the folded sheet bundle BS having a large thickness can smoothly enter between the third upper and lower pressing rollers 75 and 76, thereby reducing damage to the sheet end portion.

[Entire Arrangement and Region Setting for Folded Sheet Bundle]

Figure 21A:
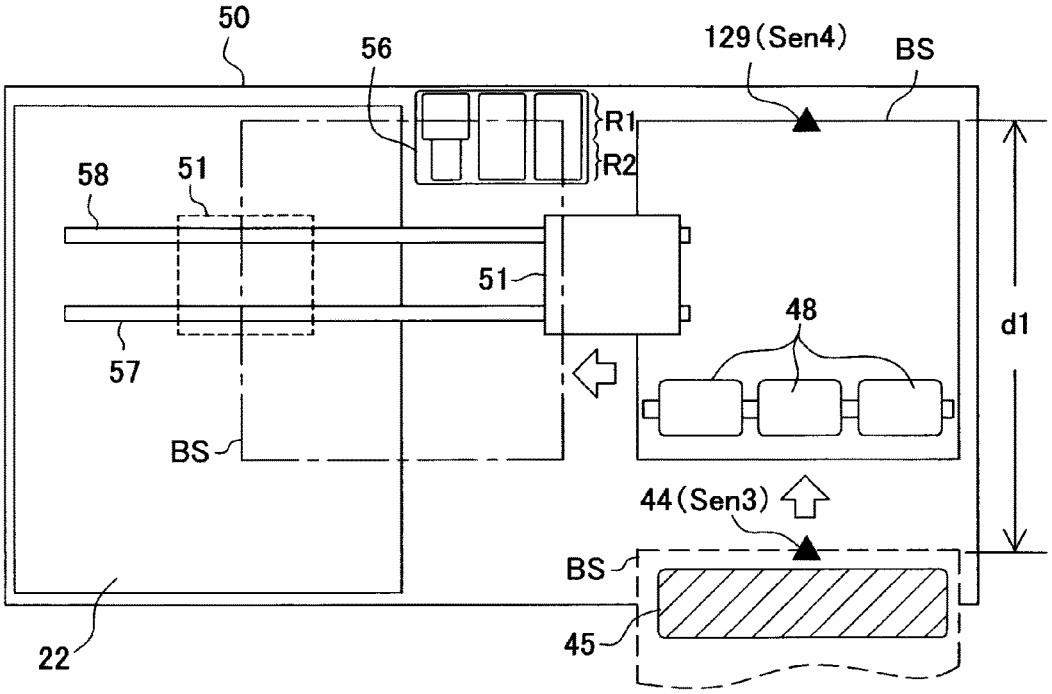
Figure 21B:
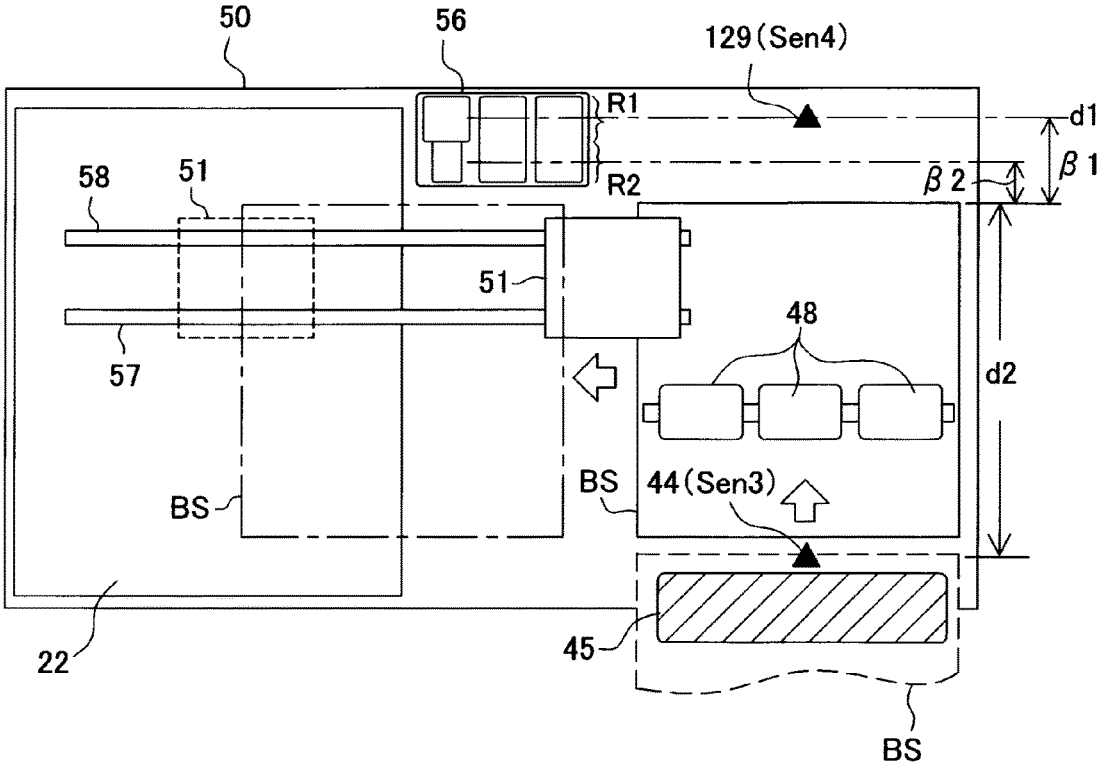

The following describes, with FIGS. 21A and 21B, the entire arrangement of a mechanism in which the folded sheet bundle BS having the folding loop that has passed through the folding roller 45 and the relay roller 48 is moved by the gripper member 51 in the direction crossing the conveying direction of the folding roller 45 and the relay roller 48. Further, a description will be given of a mechanism and control for selecting whether to position a fold leading end (back) of the folded sheet bundle BS at the region R1 where the upper roller large-diameter portion 75*a* and the lower roller large-diameter portion 76*a* are brought into pressure contact with each other, to position the fold leading end at the region R2 where there is a gap between the opposing upper and lower roller small-diameter portion 75*b* and 76*b*, or to directly discharge the folded sheet bundle BS to the second sheet discharge tray 22 without the sheet pressing.

As described using FIG. 4, movement of the folded sheet bundle BS from the folding roller 45 is illustrated in FIG. 21A. Further, in FIG. 21A, movement of the folded sheet bundles BS in the crossing direction is illustrated. A part of sheet bundles BS accumulated in the stacker section 35 is folded by the folding roller 45 to be the folded sheet bundle BS having the folding loop and conveyed. A loop leading end BL1 thus formed is detected by the sheet bundle detection sensor (SEN3) 44 positioned immediately after the folding roller 45. Afterward, the folded sheet bundle BS is conveyed downstream while being held between the relay roller pair 48 that can contact and separate from the folded sheet bundle BS. This conveyance is stopped when the folded sheet bundle BS is conveyed by a distance d1 from a position detected by the sheet bundle detection sensor (SEN3) 44. This stop position is detected also by the sheet bundle leading end detection sensor (SEN4) 129 for confirmation. This stop position corresponds to the region R1 of the upper roller large-diameter portion 75*a* and the lower roller large-diameter portion 76*a* of the pressing rollers 70 disposed at a side of the stop position. The folded sheet bundle BS formed by a small number of sheets (15 sheets, in the present embodiment) is conveyed to this position.

Further, it can be seen from this arrangement that the support unit 56 is provided at a side of the end portion of the folded sheet bundle BS conveyed by d1 in the sheet carry-in direction by the relay roller 48.

The side portion of the folded sheet bundle BS in a stopped state is gripped by the gripper member 51 described using FIGS. 6, 8A to 8C, and 12. In this state, the folded sheet bundle BS is pulled by the gripper member 51 to the left in the drawing, i.e., in the crossing direction (orthogonal direction in the present embodiment) for hand-over movement. In this movement, as indicated by a long dashed short dashed line in FIG. 7A, the folding loop BL at the leading end side is pressed by the pressing rollers 70 supported by the support unit 56. More specifically, the folding loop BL passes through the region R1 of the upper and lower roller large-diameter portions 75*a* and 76*a* and is pressed.

When the pressing is not applied to the folding loop, the folded sheet bundle BS is handed over to the gripper member 51 at the d2 position (position distanced from a position where the folded sheet bundle BS is detected by the sheet bundle detection sensor (SEN3) 44 by d2) upstream of the d1 position by β1, that is, at a position upstream of the side portion of the support unit 56. Thus, the support unit 56 is not positioned at the side of the folding loop of the folded sheet bundle BS, so that the folded sheet bundle BS is directly discharged to the second sheet discharge tray 22 without being pressed. In this case, the gripper member 51 can be moved at high speed, whereby the entire processing speed can be increased.

On the other hand, in a case where the sheet pressing is executed even when the folded sheet bundle BS is formed by a large number of sheets (in the present embodiment, 16 sheets or more), the folded sheet bundle BS is handed over at the d3 position (position distanced from a position where the folded sheet bundle BS is detected by the sheet bundle detection sensor (SEN3) 44 by d3) downstream of the d2 position by β2. This position corresponds to a pressing position for the folded sheet bundle BS formed by a large number of sheets, i.e., to the region R2 where the folded sheet bundle BS is held between the upper roller small-diameter portion 75*b* of the third upper pressing roller 75 and the lower roller small-diameter portion 76*b* of the third lower pressing roller 76. This is because if the pressing roller pair of the final step is in a completely pressure contact state, impact upon entering of the folded sheet bundle BS is large to cause bending of the folded sheet bundle BS or come-off of the folded sheet bundle BS from the gripper member 51.

As described using FIG. 4, when the folded sheet bundle BS is relayed to the gripper member 51 for movement thereof in the crossing direction, the relay upper and lower rollers 48*a* and 48*b* of the relay roller 48 are separated from each other so as not to act as resistance to the movement of the folded sheet bundle BS by the gripper member 51. In place of separating the relay upper and lower rollers 48*a* and 48*b*, pressure contact force between them may be reduced.

As described above, in the present embodiment, by changing the hand-over position from the relay roller 48 to the gripper member 51 (that is, by changing the grip position of the gripper member 51), it is possible to easily select whether to execute the sheet pressing (both in the cases where the folded sheet bundle BS is formed by a small number of sheets and where the folded sheet bundle BS is formed by a large number of sheets) or not.

Hereinafter, with reference to flowcharts of FIGS. 22 and 23A, 23B, and 23C, the case where the sheet pressing is executed for the folded sheet bundle BS formed by a small number of sheets and folded sheet bundle BS formed by a large number of sheets and case where the sheet pressing is not executed will be described according to the steps (S).

Before description of the steps (S), the processing modes designated through the control panel 18 as the sheet processing conditions are confirmed. As described above, the processing modes include: (1) "print-out mode", (2) "staple-binding mode", (3) "saddle stitching and folding mode", and (4) "Sheet pressing mode". The (4) "Sheet pressing mode" includes "sheet pressing for thin sheet bundle (15 sheets or less, in the present embodiment)" and "sheet pressing for thick sheet bundle (16 sheets or more, in the present embodiment)".

First, for the "sheet pressing mode", whether the sheet pressing is executed or not is designated through the control panel 18. Then, the processing mode shifts to the "sheet pressing mode". When the above designation is not made, the processing mode shifts to the "saddle stitching and folding mode" (No in S301) where the sheet bundle subjected to only the saddle stitching and folding is discharged to the second sheet discharge tray without being pressed. When the "sheet pressing mode" is designated, the sheet bundle is folded in two by the folding roller 45 and the folding blade 46 and then conveyed to the sheet pressing device 50 having the relay roller 48. In this process, it is determined whether the number of sheets is equal to or less than 15 sheets (30 sheets in a folded state) or more than 15 sheets (S302). In place of the number of sheets, the large number of sheets and small number of sheets may be determined based on the thickness. Although not illustrated especially, the above determination may be made based on a result of measurement of an interval between the upper and lower pressure contact rollers 45*a* and 45*b* of the folding roller 45 when the sheet bundle is inserted into the folding roller 45 or sheet number information from the image forming device A. Hereinafter, cases where the folded sheet bundle is formed by a small number of sheets and where it is formed by a large number of sheets will be described separately.

[For Small Number of Sheets]

When the folded sheet bundle BS is formed by 15 or less sheets, a folding motor 126 that rotates the folding roller 45 is driven into rotation (S303). After the drive rotation, the sheet bundle detection sensor (SEN3) 44 positioned immediately after the folding roller 45 detects the leading end of the folded sheet bundle (S304). After elapse of a predetermined time from the detection, the swing motor 153 illustrated in FIG. 4 is driven so as to cause the relay upper roller 48*a* of the relay roller 48 to pressure contact the folded sheet bundle BS and then stopped (S305). As a result, the folded sheet bundle BS is nipped by the relay roller 48. At the same time, the bundle feed motor 163 is driven into rotation to convey downstream the folded sheet bundle BS (S306). Here, as described above, it is checked whether or not the folded sheet bundle BS has been moved by the longest distance d1 from a position where the folded sheet bundle BS is detected by the sheet bundle detection sensor (SEN3) 44 (S307). This check is made by detecting moving amounts of the folding roller 45 and the relay roller 48. Further, it is also checked here whether the sheet bundle leading end detection sensor (SEN4) 129 has detected the folding loop leading end (S308). With this check, it can be confirmed whether there is a difference between an amount of the roller moving amount and actual position of the folding loop leading end, thereby enhancing detection reliability. The reason why the double-check is necessary is that since a comparatively thin folded sheet bundle BS is conveyed by the longest conveying distance d1, the sheet bundle BS may be bent in the middle of the conveyance. After the sheet bundle leading end detection sensor (SEN4) 129 detects the folded sheet bundle BS, the folding motor 126 for driving the folding roller 45 and the bundle feed motor 163 for driving the relay roller 48 are stopped (S309).

Figure 23A:
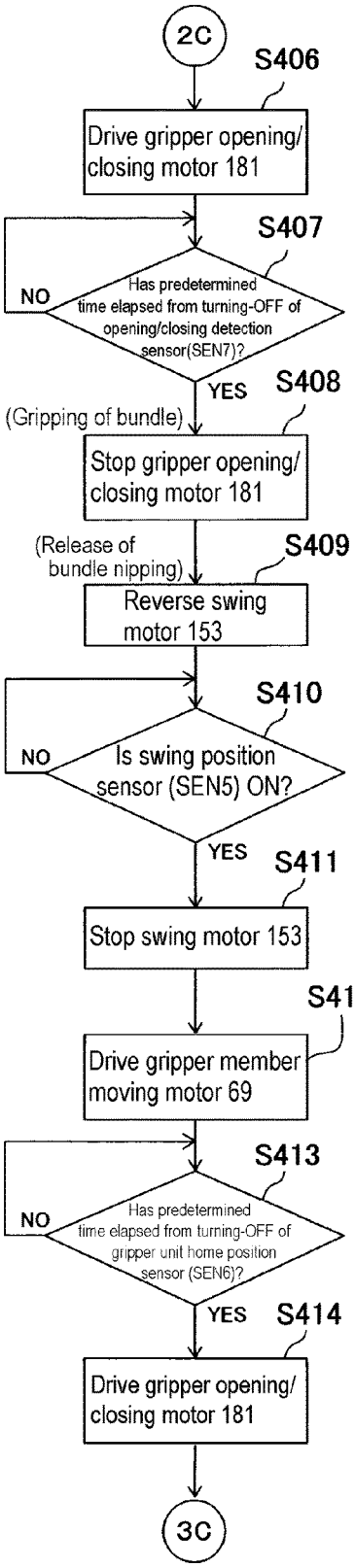
FIGS. 23A, 23B, and 23C are flowcharts continuing from FIG. 22.
Figure 23B:
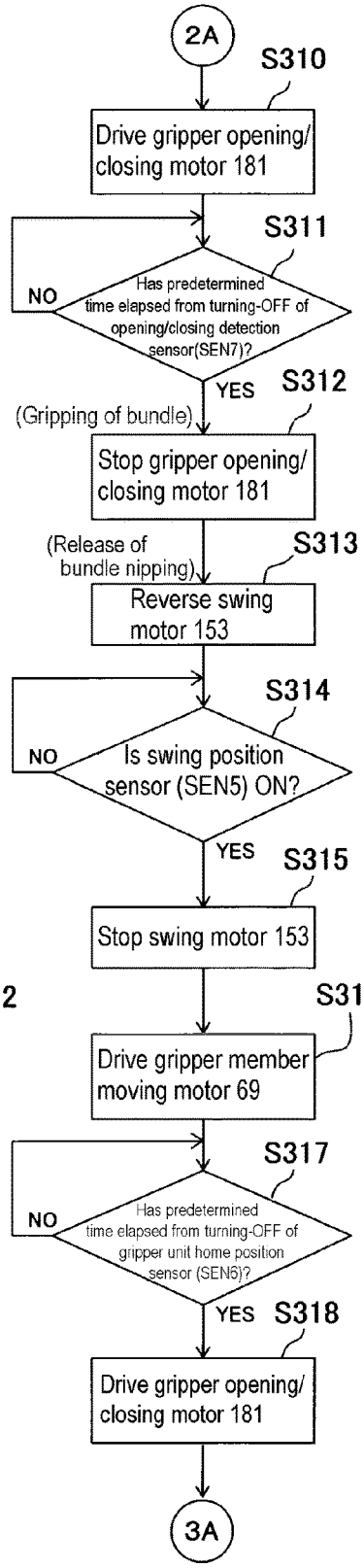
Figure 23C:
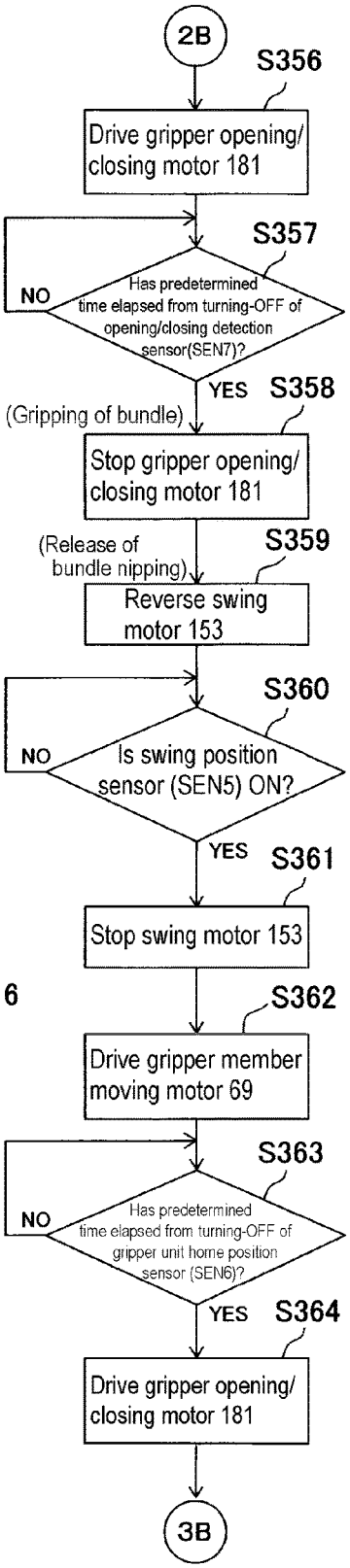

Description will be continued with reference to FIGS. 23A, 23B, and 23C. After the folding motor 126 and the bundle feed motor 163 are stopped, the gripper opening/closing motor 181 illustrated in FIG. 8A is driven (S310). The opening/closing detection sensor (SEN7) 186 that detects the lower gripper rear end 195 as illustrated in FIGS. 8B and 8C is turned OFF from ON. Then, after a predetermined time has elapsed from the turning-OFF, it is determined that the opening/closing cam 200 is in the state of FIG. 8C (S311). In this state, as described using FIG. 8C, the upper and lower grippers 171 and 173 biased, respectively, by the two coil springs 189 wound around the arm shaft 188 grip a side portion of the folded sheet bundle BS on the slightly upstream portion of the folding loop so as to leave a part of the folding loop, allowing the pulling operation of the gripper member 51 to be started.

In this state, the swing motor 153 is reversed so as to release the sheet pressing of the relay roller 48 of FIG. 4 (S313). As a result, the relay upper roller 48*a* is moved in a direction (upward in the drawing) separating from the folded sheet bundle BS. This movement is continued until the swing lever 155 is detected by the swing position sensor (SEN5) 151 (S314). After the detection, drive of the swing motor 153 is stopped (S315). In this state, the relay roller 48 is completely separated from the folded sheet bundle BS and thus does not prevent movement of the folded sheet bundle BS by the gripper member 51. Thereafter, the gripper member moving motor 69 is driven so as to move the gripper member 51 toward the second sheet discharge tray 22 as illustrated in FIG. 5 (S316). Driving the gripper member moving motor 69 for a predetermined time causes the folded sheet bundle BS to be moved to a position above the second sheet discharge tray 22. This movement is continued until a predetermined time has elapsed since the gripper frame 175 is separated from its home position to turn OFF the gripper unit home position sensor (SEN6) 176 of FIGS. 6 and 7 (S317). When the gripper member 51 reaches the discharge position where the folded sheet bundle BS is discharged, the gripper opening/closing motor 181 is driven (S318). As a result, the gripper member 51 is in the state of FIG. 8B to discharge the folded sheet bundle BS to the second sheet discharge tray 22.

Figures 24A, 24B, 24C:
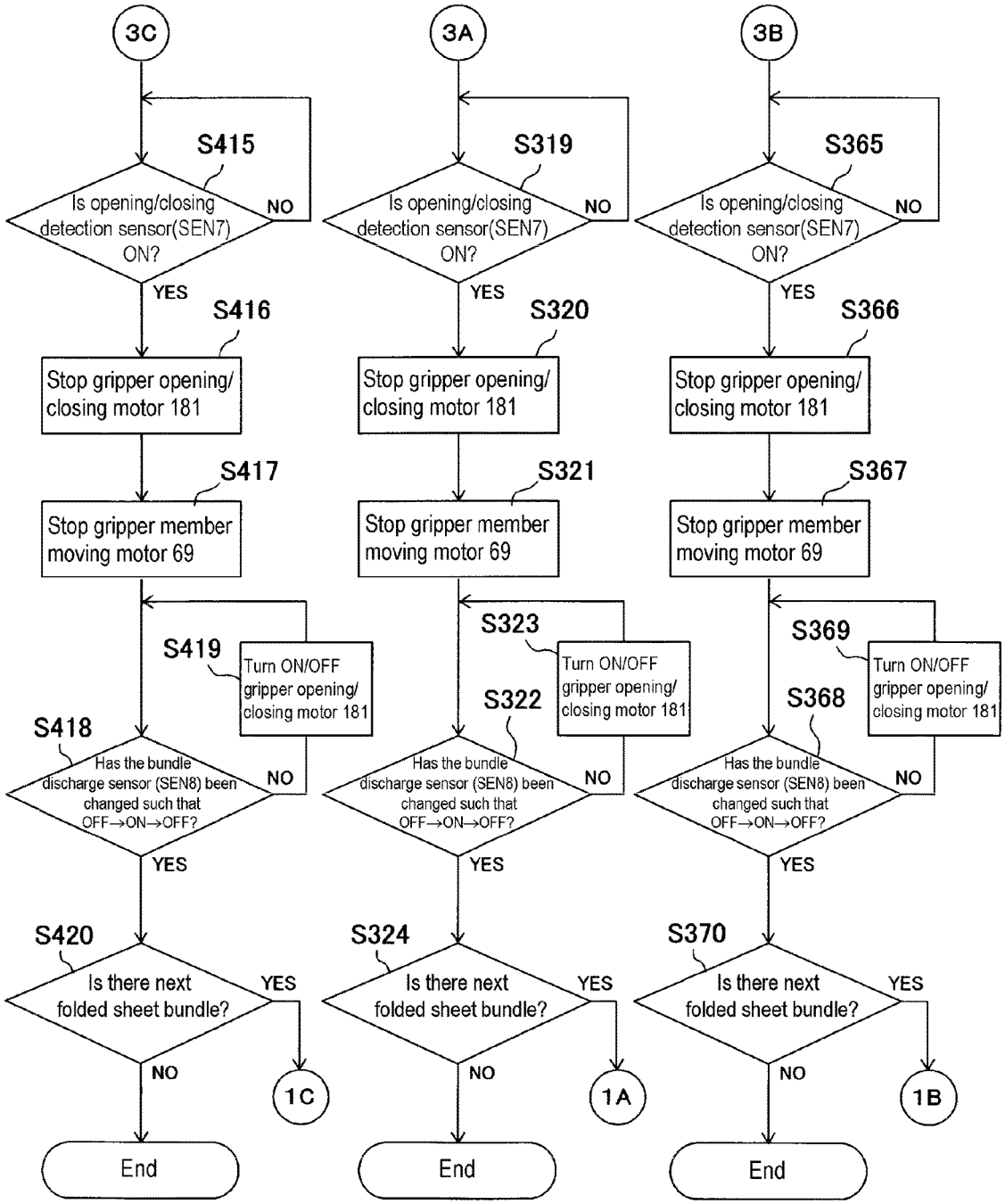
FIGS. 24A, 24B, and 24C are flowcharts continuing from FIGS. 23A, 23B, and 23C.

Description will be continued with reference to FIGS. 24A, 24B, and 24C. Referring also to FIGS. 8A to 8C, when the opening/closing detection sensor (SEN7) 186 is turned ON (S319), it is determined that the upper and lower grippers 171 and 173 are opened, and the gripper opening/closing motor 181 is stopped (S320). After completion of this motion, drive of the gripper member moving motor 69 is stopped (S321). Thereafter, it is checked whether the bundle discharge sensor (SEN8) 204 provided in the second sheet discharge tray 22 is once turned ON and then turned OFF (changed such that OFF→ON→OFF). This means that the folded sheet bundle BS is discharged to the second sheet discharge tray 22 as illustrated in FIG. 16. When the bundle discharge sensor (SEN8) 204 is once turned ON and kept at the ON state, it is determined that catching of the folded sheet bundle has occurred (No in S322).

When this state occurs, drive of the gripper opening/closing motor 181 is tuned ON/OFF (S323). When the state of the bundle discharge sensor (SEN8) 204 is changed such that OFF→ON→OFF, it is determined that normal operation is restored, and a processing flow proceeds to next step. If the bundle discharge sensor (SEN8) 204 is not turned OFF, error display is made (not illustrated). The above ON/OFF drive of the gripper opening/closing motor 181 is performed once or twice, followed by detection of the state of the bundle discharge sensor (SEN8) 204, whereby discharge of the folded sheet bundle BS to the second sheet discharge tray 22 is confirmed. With such a setting, vibration is applied to the folded sheet bundle BS through the gripper member 51 to eliminate the catching, thus reducing error. After the folded sheet bundle BS is normally discharged to the second sheet discharge tray 22, it is determined whether or not there is a next folded sheet bundle BS (S324). When there is a next folded sheet bundle BS, the processing flow returns to 1A of FIG. 22, and the operation described above is repeated.

[For Large Number of Sheets]

The following describes processing to be performed when the folded sheet bundle BS is formed by a large number of sheets. The processing for a large number of sheets is almost the same as processing for a small number of sheets, so only different points will be described. As can be seen from FIG. 22, the different points are that it is checked whether or not the folded sheet bundle BS has been moved by d3 which is the longest distance next to the d1 from a position where the folded sheet bundle BS is detected by the sheet bundle detection sensor (SEN3) 44 (S335) and that the determination on whether the folded loop leading end has been detected by the sheet bundle leading end detection sensor (SEN4) 129, which is conducted in the case of the processing for a small number of sheets, is omitted since the folded sheet bundle is comparatively thick. As a matter of course, the sheet bundle leading end detection sensor may be provided at a position corresponding to d3 for detection of the sheet bundle leading end. Other processing steps are the same as those in the processing for a small number of sheets, so description thereof will be omitted here.

[Case Where Sheet Pressing is not Performed]

Figure 22:
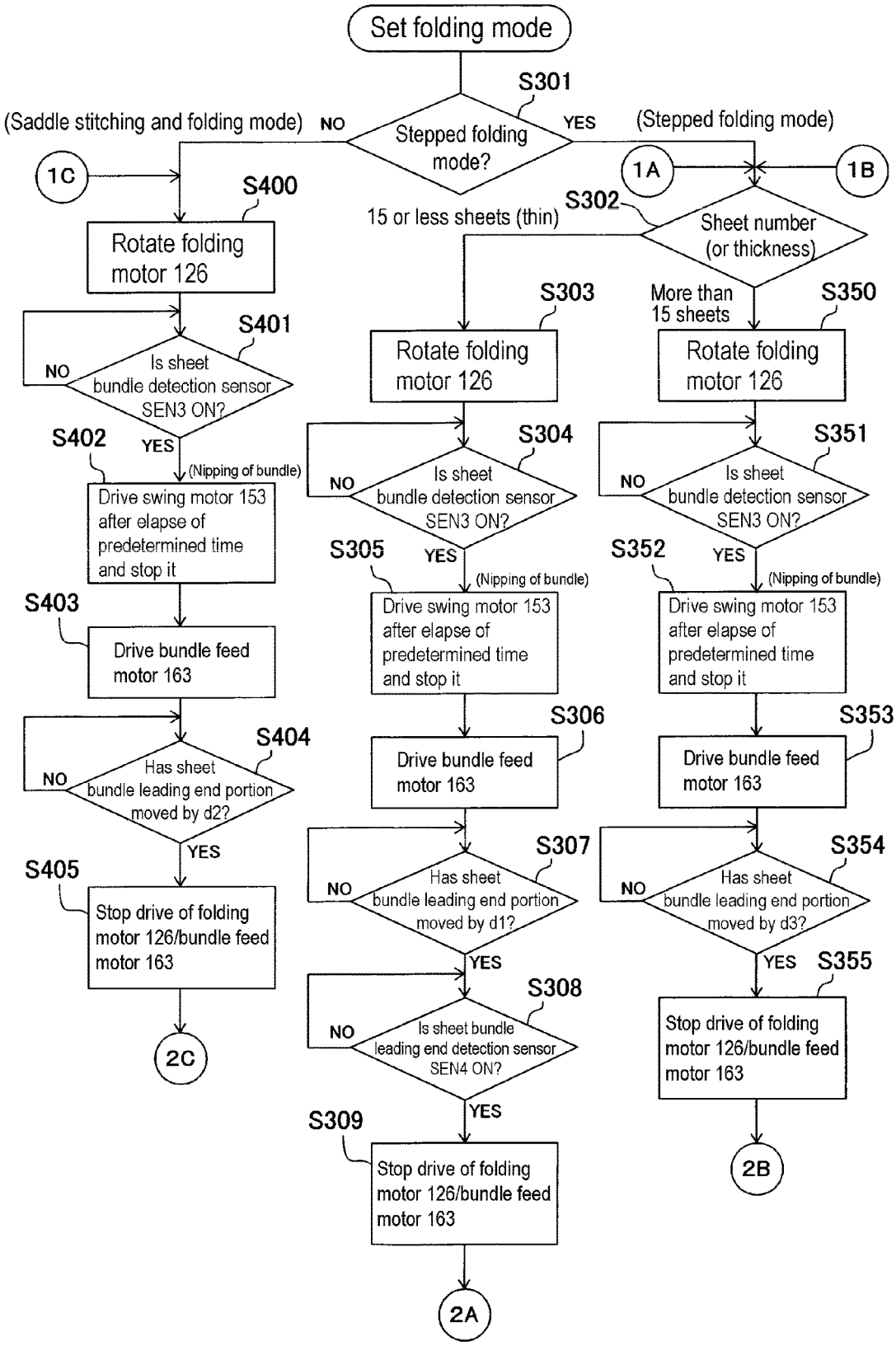
FIG. 22 is a flowchart illustrating a case where the sheet pressing is executed for the folded sheet bundle formed by a large number (equal to or larger than a predetermined number) of sheets or by a small number (less than a predetermined number) of sheets and a case where the folded sheet bundle is directly discharged without being pressed.

Similarly, as can be seen from FIG. 22, different points between the "saddle stitching and folding mode" in which the above-described sheet pressing is executed and processing for a small number of sheets are that it is checked whether or not the folded sheet bundle BS has been moved by d2 which is the shortest distance from a position where the folded sheet bundle BS is detected by the sheet bundle detection sensor (SEN3) 44 (S404) and that the determination on whether the folded loop leading end has been detected by the sheet bundle leading end detection sensor (SEN4) 129, which is conducted in the case of the processing for a small number of sheets, is omitted since the a conveying distance of the folded sheet bundle is comparatively short. As a matter of course, the sheet bundle leading end detection sensor may be provided at a position corresponding to d2 for detection of the sheet bundle leading end. Other processing steps are the same as those in the processing for a small number of sheets, so description thereof will be omitted here.

As described above, when the conveying direction is changed to a front direction crossing the conveying direction of the folding roller 45 and the relay roller 48, the hand-over position of the folded sheet bundle BS to the gripper member 51 is selectively set to the d1 position where the sheet pressing for a small number of sheets is performed, d3 position where the sheet pressing for a large number of sheets is performed, and d2 position where the folded sheet bundle BS is directly discharged without being pressed, whereby desired sheet processing can be performed.

[Control Configuration]

Figure 25:
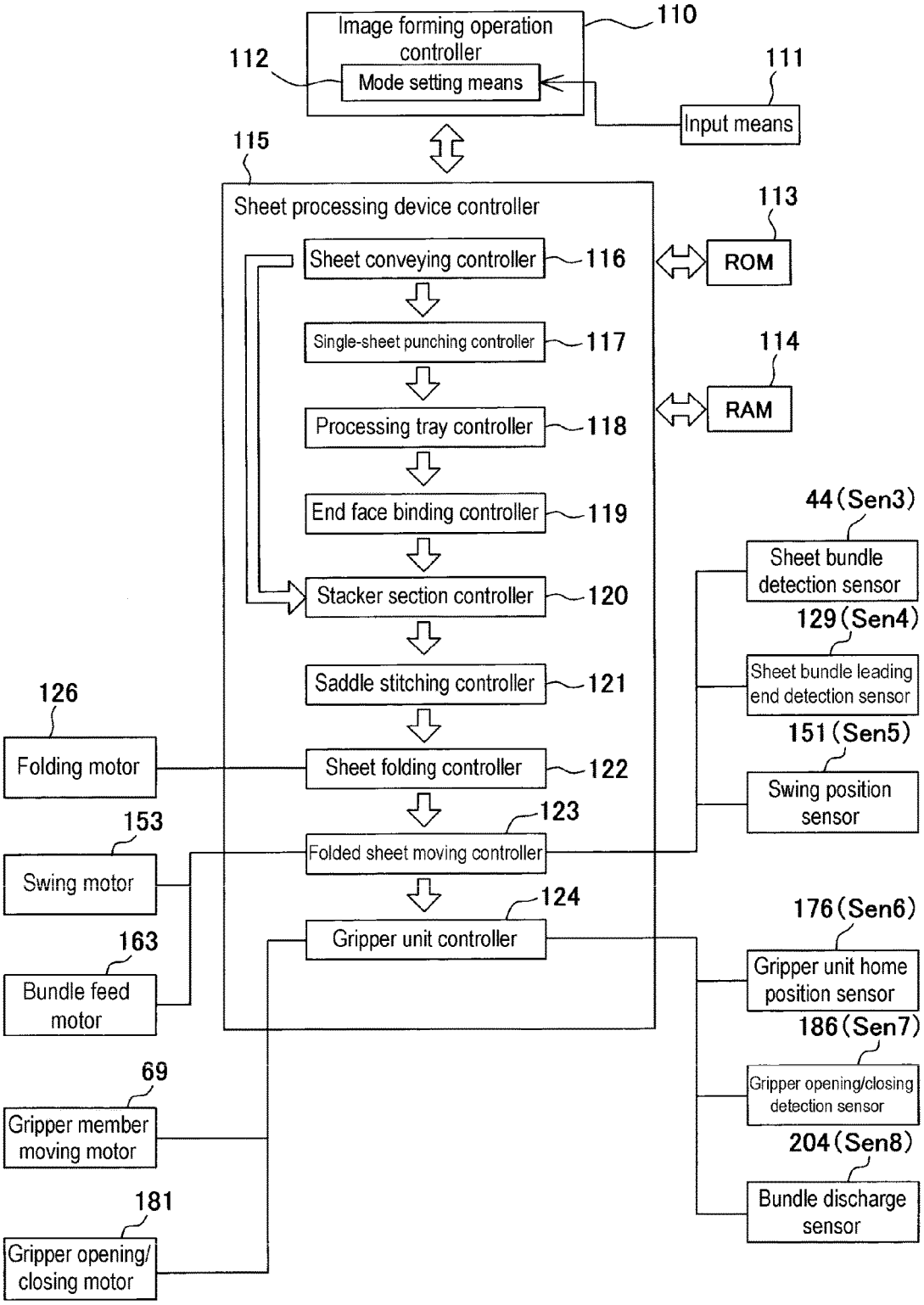
FIG. 25 is an explanatory view of a control configuration of the sheet processing device of FIG. 2.

Control configuration of the sheet processing device B provided with the thus described sheet pressing device 50 and the image forming device A including the sheet processing device B will be described based on a block diagram of FIG. 25. An image forming device controller 110 having an image forming section 2 inputs desired processing through user's operation made to an input means provided on a control panel 18. This input controls a sheet processing device controller 115 as a control unit of the sheet processing device B based on a mode setting means.

As described above, the sheet processing device B of the present embodiment includes the following four operation modes: "print-out mode", "staple-binding mode", "saddle stitching and folding mode", and "sheet pressing mode". The "sheet pressing mode" includes "sheet pressing for thin sheet bundle (15 sheets or less, in the present embodiment)" and "sheet pressing for thick sheet bundle (16 sheets or more, in the present embodiment)". These modes are manually designated or automatically selected.

The sheet processing device B includes the sheet processing device controller 115 that is made operable in one of the above four modes, a ROM that stores an operation program, and a RAM that stores control data. The sheet processing device controller 115 includes a sheet conveying controller 116 that controls sheet conveyance in the device, a single-sheet punching controller 117 that applies punching, one by one, the sheets by means of a single-sheet punching unit 28, a processing tray controller 118 that performs control of accumulating the sheets on the processing tray 29, and an end face binding controller 119 that binds the end face side of the sheets accumulated in a bundle and discharges the bound sheet bundle.

The saddle stitching or center-folding of the sheet at about a half position thereof in the sheet conveying direction is controlled by a stacker section controller 120 that accumulates the sheet bundle in the sheet stacker section 35. The stacker section controller 120 uses the stopper 38 or aligning means 39 that regulates the leading end of the sheets carried in, one by one, to the stacker section 35 to generate an aligned sheet bundle. The sheet processing device controller 115 further includes a saddle stitching controller 121 that controls the saddle stitching stapler to drive a staple or the like to a center portion of the sheet bundle and a sheet folding controller 122 that controls the folding blade 46 to push the saddle-stitched sheet bundle into the folding roller 45 to fold the sheet bundle. The sheet folding controller 122 controls the folding motor 126 that drives the folding roller 45.

As described above, the folded sheet bundle BS having the folding loop created by the folding roller 45 is conveyed downstream by the relay roller 48. This conveyance is controlled by a folded sheet moving controller 123. The folded sheet moving controller 123 is connected with the sheet bundle detection sensor (SEN3) 44 that detects the folded sheet bundle at a position immediately after the folding roller 45, sheet bundle leading end detection sensor (SEN4) 129 that detects an end point of the folded sheet bundle BS, swing position sensor (SEN5) 151 that detects a position of the swingable relay upper roller 48*a* of the relay roller 48, and, although not illustrated especially, a sensor that detects a rotation amount of the relay roller 48 in cooperation with the folding roller 45 to detect a moving amount of the folded sheet bundle BS. According to inputs from the above sensors, the folded sheet moving controller 123 controls drive of the swing motor 153 that brings the relay roller pair 48 into pressure contact with each other and separates them from each other and bundle feed motor 163 that moves the relay roller.

The gripper member 51 that conveys the folded sheet bundle BS conveyed by the relay roller 48 in a direction (orthogonal direction toward the front) crossing the conveying direction of the relay roller 48 is controlled by a gripper unit controller 124. Under control of the gripper unit controller 124, the gripper member 51 pulls the folded sheet bundle BS so as to make the folding loop of the folded sheet bundle BS pass through the pressing roller pairs 70 whose interval differs among the rows, depending on the hand-over position thereto from the relay roller 48, whereby the sheet pressing described using FIGS. 17 to 19 and FIGS. 20A to 20D is executed.

To this end, the gripper unit controller 124 is connected with the gripper unit home position sensor (SEN6) 176 that detects that the gripper member 51 is situated at the home position, opening/closing detection sensor (SEN7) 186 that detects whether or not the upper and lower grippers 171 and 173 of the gripper member 51 are opened, and bundle discharge sensor (SEN8) 204 that detects whether or not the discharge of the folded sheet bundle BS from the gripper member 51 to the second sheet discharge tray 22 is completed and receives signals from the above sensors.

An output side of the gripper unit controller 124 is connected with the gripper member moving motor 69 that moves the gripper member 51 in a direction crossing the conveying direction of the folding roller 45 and the relay roller 48 through the moving belt 65 and the gripper opening/closing motor 181 that rotates the gripper opening/closing cam 200 so as to bring the upper and lower grippers 171 and 173 of the gripper member 51 into an opened state (grip state) and closed state (grip release state).

Although the sheet processing device controller 115 as the control unit in the above embodiment is designed to be installed inside the sheet processing device B, it may be installed in the image forming section 2 or outside the processing device B or image forming section 2.

The control related especially to the present invention on whether or not to execute the sheet pressing for the folded sheet bundle and on the hand-over positions corresponding to the thin sheet bundle and thick sheet bundle has been described based on the description of the respective mechanisms and using operation state explanatory views of FIGS. 11 to 16 and flowcharts of FIGS. 22 to 24A, 24B, and 24C. So descriptions thereof will be omitted here. The loop portion of the folded sheet bundle BS is made to pass through the support unit 56 such that the pressing processing is executed according to the procedure illustrated in FIG. 20.

According to the embodiment described above, the folded sheet bundle BS conveyed by the relay roller 48 is handed over to the gripper member 51 and is then pulled by the gripper member 51 in the crossing direction. In the process of the conveyance from an upstream side to a downstream side in the crossing direction, the loop portion of the folded sheet bundle BS passes through the support unit 56. In the support unit 56, the pressing roller pair 70 of the first row presses the loop portion with a largest interval, and the pressing roller pair 70 of the next row presses the loop portion with a next largest interval. In the pressing by the pressing roller pair of the last row, a comparatively thin folded sheet bundle BS formed by a small number of sheets is pressed between the upper and lower roller large-diameter portions 75*a* and 76*a* which are brought into pressure contact (region R1). A comparatively thick folded sheet bundle BS formed by a large number of sheets is pressed between the upper and lower roller small-diameter portions 75*b* and 76*b* which have diameters smaller by $\alpha$ than those of the upper and lower roller large-diameter portions 75*a* and 76*a*, respectively, and which are separated from each other (region R2). With this configuration, even an end portion of the comparatively thick folded sheet bundle BS can easily be inserted between the upper and lower rollers, thereby reducing damage to the sheet end portion. Further, the pressing for the loop portion is performed in a course of the discharge of folded sheet bundle BS to the second sheet discharge tray 22 (conveyance in the crossing direction), so that it is not necessary to stop the conveyance of the folded sheet bundle BS.

The present invention in its preferred embodiment provides the following effects.

(1) There is provided, according to the above embodiment, a sheet processing device that presses a folding loop BL of a folded sheet bundle, the device including a device frame 55, a pair of pressing rollers 70 as a pressing member that press the folding loop in a thickness direction thereof, a support unit 56 that is mounted to the device frame 55 and supports a plurality of rows of the pressing roller pairs 70 such that intervals therebetween in the row direction are reduced stepwise, and a moving member that makes the folding loop of the folded sheet bundle pass through the support unit 56 in a direction that the intervals of the plurality of rows of pressing roller pairs 70 in the row direction are reduced stepwise, wherein the folded sheet bundle is made to pass through the support unit 56 by the moving member 51 so as to cause the folding loop to be sequentially pressed by the plurality of rows of pressing roller pairs 70.

With this configuration, the folding loop is sequentially pressed at a plurality of different positions. Thus, the folded position is directed inward, thereby preventing, as much as possible, the folded sheet bundle from being opened upon accumulation, which improves the accumulating property.

(2) In the sheet processing device of (1), the pressing roller pair 70 is a pair of rollers capable of being rotated in the moving direction of the folding loop.

With this configuration, the folding loop can be smoothly pressed.

(3) In the sheet processing device of (2), the moving member is a gripper member 51 that grips a side portion of the folded sheet bundle in a sheet thickness direction so as to leave the folding loop and pulls the folded sheet bundle, and the gripper member 51 is configured to be movable along the device frame 55.

With this configuration, movement of the folded sheet bundle through the support unit is achieved by the pulling operation of the gripper member 51, whereby the folded sheet bundle is reliably gripped and moved.

(4) In the sheet processing device of (3), the support unit is fixedly mounted to the device frame 55.

With this configuration, the support unit 56 that supports the plurality of rows of pressing roller pairs 70 such that intervals therebetween in the row direction are reduced stepwise is fixed to the device frame, thereby simplifying a device configuration.

(5) There is provided, according to the above embodiment, a sheet processing device that presses a folding loop of a folded sheet bundle, the device including a device frame 55, a first conveying member that conveys the folded sheet bundle having the folding loop, a pair of pressing rollers 70 that press the folding loop in a thickness direction thereof, a support unit 56 that is mounted to the device frame 55 and supports a plurality of rows of the pressing roller pairs 70 such that intervals therebetween in the row direction are reduced stepwise, and a second conveying member that makes the folding loop pass through the support unit 56 in a direction that the intervals of the plurality of rows of pressing roller pairs 70 in the row direction are reduced stepwise, wherein the second conveying member conveys the folded sheet bundle in a direction crossing a sheet conveying direction of the first conveying member to press the folding loop by means of the plurality of rows of pressing roller pairs 70.

With this configuration, the folding loop of the folded sheet bundle is made to pass through the support unit 56 that is mounted to the device frame 55 and supports a plurality of rows of the pressing roller pairs 70 that press stepwise the folding loop in the thickness direction thereof, so that the folds are formed at different positions in the closing direction of the folded sheet bundle, thereby preventing the folded sheet bundle from being opened upon accumulation, which improves the accumulating property. Further, the stepwise pressing is executed in the course of the conveyance of the folded sheet bundle in the crossing direction, so that a processing time can be shortened as compared to a configuration in which the pressing is executed with the conveyance of the folded sheet bundle stopped.

(6) In the sheet processing device of (5), the pressing roller pair 70 is a pair of rollers capable of being rotated in the conveying direction of the folded sheet bundle.

With this configuration, the folding loop can be smoothly pressed.

(7) In the sheet processing device of (6), the support unit 56 is fixedly mounted to the device frame 55 at a sheet side portion near a sheet end portion in the sheet conveying direction of the first conveying member.

With this configuration, the support unit 56 that supports the plurality of rows of pressing roller pairs 70 that press the loop portion is fixedly mounted to the device frame, whereby stepwise pressing can be achieved, which simplifies the device configuration.

(8) In the sheet processing device of (7), the first conveying member has a pressure contact position where the folded sheet bundle is nipped and conveyed and a release position where the pressure contact with the folded sheet bundle is released to allow movement of the folded sheet bundle, and when the folded sheet bundle is conveyed by the second conveying member in a direction crossing the conveying direction of the first conveying member, the first conveying member is shifted to the release position.

With this configuration, nipping of the folded sheet bundle by the upstream side conveying member is released when the folded sheet conveying direction is changed to the crossing direction, the hand-over of folded sheet bundle for conveyance in the crossing direction can be smoothly performed.

(9) In the sheet processing device of (8), the first conveying member includes at least a pair of relay rollers 48 as a bundle conveying roller and pressure-contacts the folded sheet bundle at the pressure contact position so as to allow the folded sheet bundle to be moved, and the second conveying member is a gripper member 51 that grips a side portion of the folded sheet bundle in a sheet thickness direction so as to leave at least a part of the folding loop and pulls the folded sheet bundle, and when the folded sheet bundle is pulled by the gripper member 51, the relay roller 48 is moved to the pressure contact release position.

With this configuration, conveyance before change of the conveying direction to the crossing direction is performed by the relay roller 48 that can contact and separate from the folded sheet bundle, and the conveyance in the crossing direction is performed by the gripper member 51 that grips the sheet side portion, whereby the sheet hand-over conveyance can be achieved reliably.

(10) There is provided, according to the above embodiment, a sheet processing device that presses a folding loop BL of a folded sheet bundle, the device including a device frame 55, a relay roller 48 as a first conveying member that conveys the folded sheet bundle having the folding loop, a gripper member 51 as a second conveying member that conveys the folded sheet bundle in a direction crossing a conveying direction of the relay roller 48, a pair of pressing rollers 70 that press the folding loop of the folded sheet bundle conveyed by the gripper member 51 in a thickness direction of the folding loop, a support unit 56 that is mounted to the device frame 55 and supports a plurality of rows of the pressing roller pairs 70 arranged from an upstream side to a downstream side in the crossing direction such that intervals therebetween in the row direction are reduced stepwise, and a sheet processing device controller 115 as a control unit that controls the relay roller 48 and the gripper member 51, wherein the sheet processing device controller 115 allows selection of whether or not to perform pressing for the folding loop by the support unit 56 depending on a sheet hand-over position from the relay roller 48 to the gripper member 51.

With this configuration, the folding loop of the folded sheet bundle is made to pass through the support unit 56 that is mounted to the device frame 55 and supports a plurality of rows of the pressing roller pairs 70 that press stepwise the folding loop in the thickness direction thereof, so that the folds are formed at different positions in the closing direction of the folded sheet bundle, thereby preventing the folded sheet bundle from being opened upon accumulation, which improves the accumulating property. Further, the stepwise pressing is executed in the course of the conveyance of the folded sheet bundle in the crossing direction, so that a processing time can be shortened as compared to a configuration in which the pressing is executed with the conveyance of the folded sheet bundle stopped. Further, it is possible to select whether or not to perform the stepwise pressing depending on the sheet hand-over position between the two conveying members.

(11) In the sheet processing device of (10), when the folding loop is passed through the support unit 56 so as to be pressed by the pressing roller pairs 70, the sheet processing device controller 115 performs control such that the folded sheet bundle is conveyed by the first conveying member up to a position where the folding loop overlaps a side portion of the support unit 56 and then handed over to the second conveying member at that position.

With this configuration, the hand-over of folded sheet bundle for conveyance in the crossing direction is made at the position overlapping the side portion of the support unit 56, allowing the subsequent stepwise sheet pressing to be executed.

(12) In the sheet processing device of (11), when the folded sheet bundle is discharged without being passed through the support unit 56, the sheet processing device controller 115 performs control such that the folded sheet bundle conveyed by the first conveying member is handed over to the second conveying member at a position short of the side portion of the support unit 56 in the conveying direction of the first conveying member.

With this configuration, the folding loop of the folded sheet bundle is made to pass, with the conveying direction thereof changed to the crossing direction, through the support unit 56 that is mounted to the device frame 55 and supports a plurality of rows of the pressing roller pairs 70 that press stepwise the folding loop in the thickness direction thereof in the course of the conveyance in the crossing direction, so that the folds are formed at different positions in the closing direction of the folded sheet bundle, thereby preventing the folded sheet bundle from being opened upon accumulation, which improves the accumulating property. Further, the stepwise pressing is executed in the course of the conveyance of the folded sheet bundle in the crossing direction, so that a processing time can be shortened as compared to a configuration in which the pressing is executed with the conveyance of the folded sheet bundle stopped. Further, it is possible to select whether or not to perform the stepwise pressing depending on the sheet hand-over position between the two conveying members.

(13) In the sheet processing device of (12), the first conveying member has a pressure contact position where the folded sheet bundle is nipped so as to be movable and a release position where the pressure contact with the folded sheet bundle is released to allow movement of the folded sheet bundle, and when the folded sheet bundle is conveyed by the second conveying member in a direction crossing the conveying direction of the first conveying member, the first conveying member is shifted to the release position.

With this configuration, nipping of the folded sheet bundle by the upstream side conveying member is released when the folded sheet conveying direction is changed to the crossing direction, the hand-over of folded sheet bundle for conveyance in the crossing direction can be smoothly performed.

(14) In the sheet processing device of (13), the first conveying member includes at least a pair of relay rollers 48 as a bundle conveying roller, the relay roller pair 48 pressure-contacting the folded sheet bundle at the pressure contact position so as to allow the folded sheet bundle to be moved and being separated from each other at the release position to release the pressure contact with the folded sheet bundle, and the second conveying member is a gripper member 51 that grips a side portion of the folded sheet bundle in a sheet thickness direction and is configured to be movable along the device frame 55.

With this configuration, conveyance before change of the conveying direction to the crossing direction is performed by the relay roller 48 that can contact and separate from the folded sheet bundle, and the conveyance in the crossing direction is performed by the gripper member 51 that grips the sheet side portion, whereby the sheet hand-over conveyance can be achieved reliably.

(15) There is provided, according to the embodiment, an image forming device including an image forming section that forms an image on a sheet and a sheet processing device that applies predetermined sheet processing to the image-formed sheet from the image forming section, wherein the sheet processing device is the sheet processing device described in (1).

With this configuration, there can be provided the image forming device providing working effects described in the above respective paragraphs.

(16) There is provided, according to the above embodiment, a sheet pressing method of a sheet processing device including a device frame 55, a pair of pressing rollers 70 that press a folding loop of a folded sheet bundle in a thickness direction thereof, a support unit 56 that is mounted to the device frame 55 and supports a plurality of rows of the pressing roller pairs 70 such that intervals therebetween in the row direction are reduced stepwise, and a gripper member 51 that makes the folding loop of the folded sheet bundle pass through the support unit 56 in a direction that the intervals of the plurality of rows of pressing roller pairs 70 in the row direction are reduced stepwise, wherein the gripper member 51 conveys the folded sheet bundle so as to make the folding loop of the folded sheet bundle pass through the support unit 56 for stepwise pressing of the folding loop.

With this configuration, the folds are formed at different positions in the closing direction of the folded sheet bundle, thereby preventing the folded sheet bundle from being opened upon accumulation, which improves the accumulating property. Further, the stepwise pressing is executed in the course of the conveyance of the folded sheet bundle in the crossing direction, so that a processing time can be shortened as compared to a configuration in which the pressing is executed with the conveyance of the folded sheet bundle stopped.

In the description of the effects of the embodiments, reference numerals are given to constituent elements recited in the claims so as to clarify a correspondence relationship between the description of "Detailed Description" and the description of "What is Claimed is".

Further, it should be appreciated that the present invention is not limited to the present embodiment, and various modifications may be made thereto. Further, all technical matters included in the technical ideas set forth in the claims should be covered by the present invention. While the invention has been described based on a preferred embodiment, those skilled in the art can realize various substitutions, corrections, modifications, or improvements may be made from the content disclosed in the specification by a person skilled in the art, which are included in the scope defined by the appended claims.

This application is based upon and claims the benefit of priority from prior Japanese Patent Applications No. 2015-011471, No. 2015-011472, and No. 2015-011473, all filed on Jan. 23, 2015, the entire contents of which are incorporated herein by reference.

What is claimed is:

1. A sheet processing device that presses a folded sheet bundle, comprising:

a device frame;

a pair of pressing members that presses a folding loop of the folded sheet bundle in a thickness direction thereof;

a support unit that is mounted to the device frame and supports a plurality of rows of pressing member pairs such that intervals therebetween in a row direction are reduced stepwise; and a moving member that makes the folding loop of the folded sheet bundle pass through the support unit in a direction that the intervals of the plurality of rows of pressing member pairs in the row direction are reduced stepwise, wherein the folded sheet bundle is made to pass through the support unit by the moving member so as to cause the folding loop to be sequentially pressed by the plurality of rows of pressing member pairs.

2. The sheet processing device according to claim 1, wherein the pressing member pair is a pair of rollers capable of being rotated in a moving direction of the folding loop.

3. The sheet processing device according to claim 2, wherein the moving member is a gripper member that grips a side portion of the folded sheet bundle in a sheet thickness direction so as to leave the folding loop and pulls the folded sheet bundle, and the gripper member is configured to be movable along the device frame.

4. The sheet processing device according to claim 3, wherein the support unit is fixedly mounted to the device frame.

5. A sheet processing device that presses a folded sheet bundle, comprising:

a device frame;

a first conveying member that conveys the folded sheet bundle having a folding loop;

a pair of pressing members that presses the folding loop in a thickness direction thereof;

a support unit that is mounted to the device frame and supports a plurality of rows of pressing member pairs such that intervals therebetween in a row direction are reduced stepwise; and a second conveying member that makes the folding loop pass through the support unit in a direction that the intervals of the plurality of rows of pressing member pairs in the row direction are reduced stepwise, wherein the second conveying member conveys the folded sheet bundle in a direction crossing a sheet conveying direction of the first conveying member to press the folding loop by means of the plurality of rows of pressing member pairs.

6. The sheet processing device according to claim 5, wherein the pressing member pair is a pair of rollers capable of being rotated in a conveying direction of the folded sheet bundle.

7. The sheet processing device according to claim 6, wherein the support unit is fixedly mounted to the device frame at a sheet side portion near a sheet end portion in the sheet conveying direction of the first conveying member.

8. The sheet processing device according to claim 7, wherein the first conveying member has a pressure contact position where the folded sheet bundle is nipped and conveyed and a release position where a pressure contact with the folded sheet bundle is released to allow movement of the folded sheet bundle, and when the folded sheet bundle is conveyed by the second conveying member in a direction crossing the conveying direction of the first conveying member, the first conveying member is shifted to the release position.

9. The sheet processing device according to claim 8, wherein the first conveying member includes at least a pair of bundle conveying rollers and pressure-contacts the folded sheet bundle at the pressure contact position so as to allow the folded sheet bundle to be moved, the second conveying member is a gripper member that grips a side portion of the folded sheet bundle in a sheet thickness direction so as to leave at least a part of the folding loop and pulls the folded sheet bundle, and when the folded sheet bundle is pulled by the gripper member, the bundle conveying roller is moved to the release position.

10. A sheet processing device that presses a folded sheet bundle, comprising:

a device frame, a first conveying member that conveys the folded sheet bundle having a folding loop;

a second conveying member that conveys the folded sheet bundle in a direction crossing a conveying direction of the first conveying member;

a pair of pressing members that presses the folding loop of the folded sheet bundle conveyed by the second conveying member in a thickness direction of the folding loop;

a support unit that is mounted to the device frame and supports a plurality of rows of pressing member pairs arranged from an upstream side to a downstream side in a crossing direction such that intervals therebetween in a row direction are reduced stepwise; and a control unit that controls the first and second conveying members, wherein the control unit allows selection of whether or not to perform pressing for the folding loop by the support unit depending on a sheet hand-over position from the first conveying member to the second conveying member.

11. The sheet processing device according to claim 10, wherein when the folding loop is passed through the support unit so as to be pressed by the pressing member pairs, the control unit performs control such that the folded sheet bundle is conveyed by the first conveying member up to a position where the folding loop overlaps a side portion of the support unit and then handed over to the second conveying member at that position.

12. The sheet processing device according to claim 11, wherein when the folded sheet bundle is discharged without being pressed through the support unit, the control unit performs control such that the folded sheet bundle conveyed by the first conveying member is handed over to the second conveying member at a position short of the side portion of the support unit in the conveying direction of the first conveying member.

13. The sheet processing device according to claim 12, wherein the first conveying member has a pressure contact position where the folded sheet bundle is nipped so as to be movable and a release position where a pressure contact with the folded sheet bundle is released to allow movement of the folded sheet bundle, and when the folded sheet bundle is conveyed by the second conveying member in a direction crossing the conveying direction of the first conveying member, the first conveying member is shifted to the release position.

14. The sheet processing device according to claim 13, wherein the first conveying member includes at least a pair of bundle conveying rollers, the relay roller pair pressure-contacting the folded sheet bundle at the pressure contact position so as to allow the folded sheet bundle to be moved and being separated from each other at the release position to release the pressure contact with the folded sheet bundle, and the second conveying member is a gripper member that grips a side portion of the folded sheet bundle in a sheet thickness direction and is configured to be movable along the device frame.

15. An image forming device comprising:

an image forming section that forms an image on a sheet; and a sheet processing device that applies predetermined sheet processing to the image-formed sheet from the image forming section, wherein the sheet processing device is the sheet processing device as claimed in claim 1.

16. A sheet pressing method of a sheet processing device, comprising the steps of:

a providing step of providing a pair of pressing members that presses a folding loop of a folded sheet bundle in a thickness direction thereof, a pressing member pairs being arranged such that intervals therebetween in a row direction are reduced stepwise, and a moving member that makes the folding loop of the folded sheet bundle pass in a direction that the intervals of plurality of rows of pressing member pairs in the row direction are reduced stepwise, a carrying-in step of carrying the folding loop of the folded sheet bundle into the pressing member pairs by the moving member, a conveying step of, following the carrying-in step, continuously conveying the folding loop of the folded sheet bundle in the direction that the intervals of the plurality of rows of pressing member pairs in the row direction are reduced stepwise by the moving member, and a passage completion step of, following the conveying step, passing the folding loop of the folded sheet bundle through the pressing member pairs by the moving member, wherein the folding loop of the folded sheet bundle is sequentially pressed.

* * * * *